US010221634B2

(12) United States Patent
Bowley et al.

(10) Patent No.: US 10,221,634 B2
(45) Date of Patent: Mar. 5, 2019

(54) CATWALK SYSTEM AND METHOD

(71) Applicant: Nabors Drilling Technologies USA, Inc., Houston, TX (US)

(72) Inventors: Ryan Thomas Bowley, Calgary (CA); Leon Keith Jantzen, Calgary (CA); Brent James-William Coombe, Calgary (CA)

(73) Assignee: Nabors Drilling Technologies USA, Inc., Houston, TX (US)

( * ) Notice: Subject to any disclaimer, the term of this patent is extended or adjusted under 35 U.S.C. 154(b) by 114 days.

(21) Appl. No.: 15/098,187

(22) Filed: Apr. 13, 2016

(65) Prior Publication Data

US 2016/0305201 A1 Oct. 20, 2016

Related U.S. Application Data

(60) Provisional application No. 62/147,477, filed on Apr. 14, 2015.

(51) Int. Cl.
*E21B 19/08* (2006.01)
*E21B 19/14* (2006.01)

(52) U.S. Cl.
CPC ..... *E21B 19/08* (2013.01); *E21B 19/14* (2013.01)

(58) Field of Classification Search
CPC ..... E21B 19/08; E21B 19/084; E21B 19/086
USPC ..... 414/22.51, 22.62
See application file for complete search history.

(56) References Cited

U.S. PATENT DOCUMENTS 2,113,270 A * 4/1938 Hall ..... E21B 19/155 414/22.57
2,922,533 A * 1/1960 Barge, Jr. ..... B23Q 1/54 187/211
3,259,255 A * 7/1966 Cresci ..... B60P 1/02 254/3 R
3,559,821 A * 2/1971 James ..... E21B 19/155 254/124
3,741,315 A * 6/1973 Hilton ..... E21B 7/24 173/105
3,792,783 A * 2/1974 Brown ..... E21B 19/15 175/85
4,290,733 A * 9/1981 Lahman ..... A01D 87/126 280/83
4,382,738 A * 5/1983 Frias ..... E21B 19/15 414/22.61

(Continued)

FOREIGN PATENT DOCUMENTS

CA 2224638 6/1999

OTHER PUBLICATIONS

PCT/US2016/027566 International Search Report and Written Opinion dated Jul. 8, 2016.

*Primary Examiner* — Joseph A Dillon, Jr.
(74) *Attorney, Agent, or Firm* — Abel Law Group, LLP; Enrique Abarca

(57) ABSTRACT

Present embodiments are directed to a catwalk system that includes a base, a plurality of columns extending from the base, where each of the plurality of columns is rigid in an erected position, and a carriage and trough assembly configured to translate along the plurality of columns to lift a tubular element from a lowered position to a raised position in a substantially horizontal orientation, where the plurality of columns is configured to remain stationary as the carriage and trough assembly is translated from the lowered position to the raised position.

10 Claims, 20 Drawing Sheets

(56) References Cited

U.S. PATENT DOCUMENTS 4,426,182 A 1/1984 Frias et al.
4,684,314 A * 8/1987 Luth ..... B60P 1/025 104/45
6,079,925 A * 6/2000 Morgan ..... E21B 19/14 414/22.57
6,814,161 B1 * 11/2004 Draney ..... E21B 19/08 175/113
7,635,249 B2 * 12/2009 Guidroz ..... E21B 19/14 414/22.52
7,665,944 B2 * 2/2010 Guidroz ..... E21B 19/14 187/211
8,210,279 B2 * 7/2012 Tarique ..... E21B 19/155 166/380
8,899,901 B2 * 12/2014 Hilton ..... E21B 19/14 414/22.54
8,936,424 B1 * 1/2015 Barnes ..... E21B 19/02 414/22.63
9,267,342 B2 * 2/2016 Hilton ..... E21B 19/15
9,488,016 B2 * 11/2016 Gubbins ..... B66D 3/003
9,506,302 B2 * 11/2016 Swanson ..... E21B 19/15
9,546,522 B2 * 1/2017 In ..... E21B 1/00
2006/0045654 A1 3/2006 Guidroz
2009/0252576 A1 * 10/2009 Gerber ..... E21B 19/00 414/22.54
2010/0135750 A1 * 6/2010 Tarique ..... E21B 19/155 414/22.54
2012/0130537 A1 5/2012 Gerber
2014/0030025 A1 * 1/2014 Bernardoni ..... E21B 7/02 405/184
2014/0190714 A1 * 7/2014 In ..... E21B 1/00 173/31
2016/0215622 A1 * 7/2016 Nelson ..... E21D 20/003
2016/0251916 A1 * 9/2016 Arbelaez ..... E21B 19/15 414/22.59
2016/0340986 A1 * 11/2016 Andreychuk ..... E21B 19/00

* cited by examiner

CATWALK SYSTEM AND METHOD

CROSS REFERENCE TO RELATED APPLICATION

This application claims the benefit of U.S. Provisional Application No. 62/147,477, entitled "CATWALK SYSTEM AND METHOD," filed Apr. 14, 2015, which is hereby incorporated by reference in its entirety.

BACKGROUND

Embodiments of the present disclosure relate generally to the field of drilling and processing of wells. More particularly, present embodiments relate to systems and methods for transporting tubular onto a drilling rig.

In conventional oil and gas operations, a well is typically drilled to a desired depth with a drill string, which includes drill pipe and a drilling bottom hole assembly. Once the desired depth is reached, the drill string is removed from the hole and casing is run into the vacant hole. Casing may be defined as pipe or tubular that is placed in a well to prevent the well from caving in, to contain fluids, and to assist with efficient extraction of product. Tubular may be defined as including drill pipe, casing, or any other type of substantially cylindrical component or assembly utilized in drilling or well processing operations.

In conventional operations, the drill string is lowered into the wellbore from an elevated rig floor. Prior to adding a new length of tubular to the drill string, the tubular is first transported from a pipe rack near the ground onto the elevated rig floor. Once above the rig floor, the tubular is typically positioned above an opening in the rig floor, such as above well center or above a mousehole of the drilling rig. The tubular can then be connected to other lengths of tubular or lowered into the opening.

It is now recognized that there exists a need for improved systems and methods for transporting tubular onto the elevated rig floor.

BRIEF DESCRIPTION

In accordance with one embodiment of the disclosure, a catwalk system includes a base, a plurality of columns extending from the base, where each of the plurality of columns is rigid in an erected position, and a carriage and trough assembly configured to translate along the plurality of columns to lift a tubular element from a lowered position to a raised position in a substantially horizontal orientation, where the plurality of columns is configured to remain stationary as the carriage and trough assembly is translated from the lowered position to the raised position.

In accordance with another embodiment of the disclosure, a system includes a carriage and trough assembly configured to support a tubular element being raised from a lowered position to a lifted position. The carriage and trough assembly includes a carriage and a trough disposed within the carriage, where the trough is configured to extend horizontally from the carriage, and where the trough includes a conveyor assembly configured to move relative to the trough and receive and transport a tubular element.

In accordance with a further embodiment of the disclosure, a method includes loading a tubular element onto a carriage and trough assembly of a catwalk system, where the catwalk system includes a plurality of columns, raising the carriage and trough assembly in a substantially horizontal orientation along the plurality of columns from a lowered position to a raised position, extending a trough of the carriage and trough assembly from a carriage of the carriage and trough assembly toward an elevated rig floor, and conveying the tubular element along the trough toward the elevated rig floor via a conveyor extending a length of the trough.

DRAWINGS

These and other features, aspects, and advantages of the present embodiments will become better understood when the following detailed description is read with reference to the accompanying drawings in which like characters represent like parts throughout the drawings, wherein.

Figure 22:
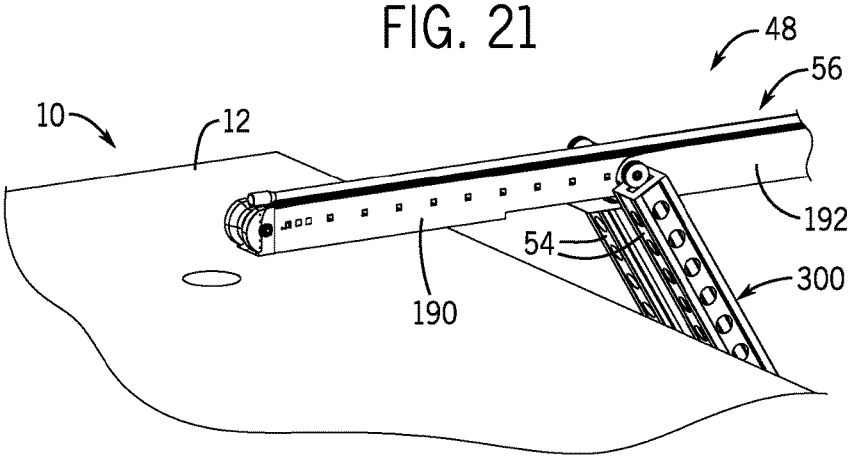
Figure 23:
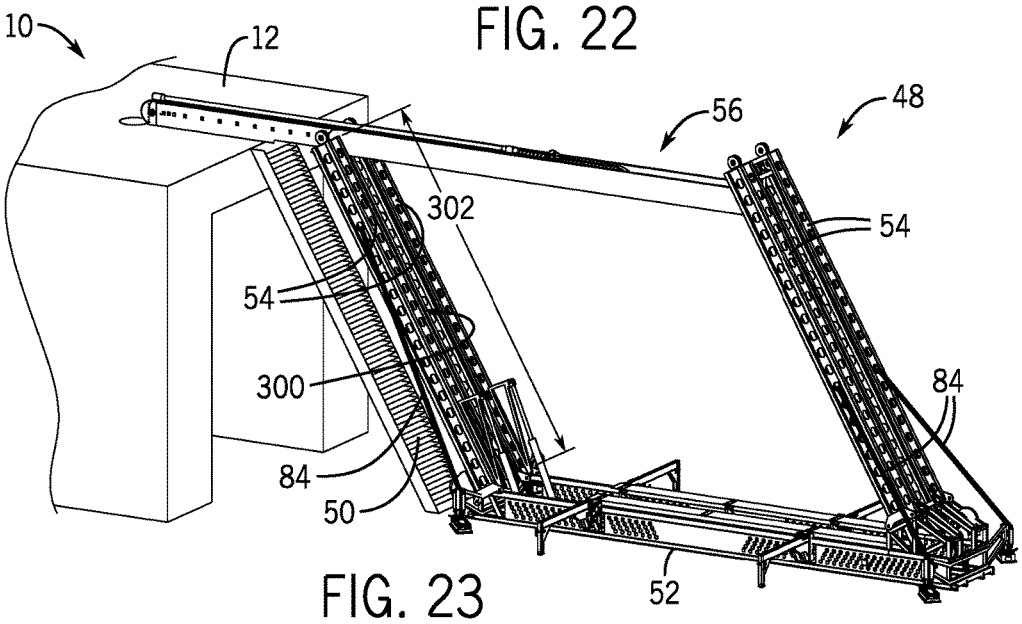

FIG. 22 is a partial perspective view of a catwalk system, illustrating the carriage and trough assembly in a raised position with the trough in an extended position, in accordance with an embodiment of the present techniques; and FIG. 23 is a perspective view of a catwalk system, illustrating the carriage and trough assembly in a raised position with the trough in an extended position, in accordance with an embodiment of the present techniques;

DETAILED DESCRIPTION

Presently disclosed embodiments are directed toward systems and methods for transporting tubular from a ground position to a position above an elevated rig floor of a drilling rig. Specifically, the systems include a catwalk system that lifts a tubular from a ground position to a position above the elevated rig floor in a substantially horizontal orientation (e.g., plus or minus 0 to 25, 1 to 15, 2 to 10, or 3 to 5 degrees). For example, the catwalk system may include columns or posts that support a horizontally oriented carriage and trough. The columns or posts may not include pivoting linkages or other pivoting members. Instead, the columns or posts may be single piece extensions, multi-segment telescoping extensions, or other support members, where the one or more segments of each column or post do not pivot relative to one another when the columns or posts are erected. The columns or posts may also be fixed in place with braces or other supports. Thus, when the columns or posts are erected, they may be rigid members that will not inadvertently pivot or rotate.

After the columns or posts are erected, a carriage and trough assembly supporting a tubular may be raised in a substantially horizontal orientation (e.g., plus or minus 0 to 20, 1 to 15, 2 to 10, or 3 to 5 degrees). For example, the carriage and trough assembly may travel along tracks or other guiding system of the columns. The carriage and trough assembly may be raised by a system of pulleys, cables (e.g., steel cables), chains, winches, gears, telescoping hydraulic cylinders, and/or other components. Once the carriage and trough assembly is in a lifted position above the elevated rig floor, a distance between the carriage and trough assembly and the rig floor may remain. Accordingly, a conveyor or apron feeder of the carriage and trough assembly may be extended (e.g., cantilevered) at least partially over the rig floor. Thereafter, the conveyor or apron feeder may operate to deliver the tubular to the rig floor. For example, the conveyor may include a belt or plates attached to a chain arranged in a conveyor configuration that may rotate about pulleys and/or rollers and/or sprockets to move the tubular onto the drilling rig floor. As will be appreciated, the substantially horizontal orientation (e.g., plus or minus 0 to 20, 1 to 15, 2 to 10, or 3 to 5 degrees) of the carriage and trough assembly enables the conveyor to translate the tubular onto the rig floor without a skate or other driving member. In other words, the tubular may remain stationary relative to the belt or apron of the conveyor, and the conveyor may deliver the tubular onto the rig floor, thereby reducing wear (e.g., abrasion, corrosion, etc.) on the tubular that may be caused by traditional catwalks.

It should be noted, in other embodiments, the columns or posts may be configured to translate a non-horizontally oriented carriage and trough. For example, a first end of the carriage and trough may be directed along the columns or posts for a predetermined amount of time. Once the predetermined amount of time has lapsed, a second end of the carriage and trough may also be directed along the columns or posts at the same rate as the first end of the carriage and trough (e.g., the first end and the second end of the carriage and trough maintain an angled orientation along the columns or posts). In some embodiments, the carriage and trough may be raised along the columns or post at the same time but at different rates of speed. Accordingly, the first end of the carriage and trough may be offset in the angled orientation (e.g., non-horizontal orientation) from the second end of the carriage and trough as the carriage and trough is translated along the columns or posts. In some cases, the first end of the carriage and trough may stop when it reaches a distal end of the columns or posts, and the second end of the carriage and trough may continue to translate along the columns or posts until the second end of the carriage and trough also reaches the distal end of the columns or posts. Accordingly, at the distal end of the columns or posts, the first end and the second end of the carriage and trough may be oriented in a substantially horizontal (e.g., within plus or minus 0 to 25 degrees, 1 to 15 degrees, 2 to 10 degrees, or 3 to 5 degrees) orientation. In other embodiments, the second end of the carriage and trough may stop when the first end of the carriage and trough reaches the distal end of the columns or posts, such that the tubular is delivered to the rig floor at the angled orientation.

Furthermore, present embodiments include a catwalk system and method that does not engage or touch the drilling rig or its components. For example, when the catwalk assembly 48 is in the raised position, the catwalk system may not touch or engage a V-door of the drilling rig as a result of the distance between the carriage and trough assembly and the rig floor. Indeed the catwalk assembly 48 may be placed far enough away from the V-door so as not to block use of the V-door when the catwalk system is positioned next to the drilling rig. In other words, the catwalk system may be a modular and/or independent system that does not rely on other components of the drilling rig to operate and does not interfere with operation of other components of the drilling rig, such as the V-door. As will be appreciated, the disclosed embodiments may be particularly useful for drilling rig floors higher than 35, 40, or 45 feet from a ground surface and/or drilling rigs with large offset to the well centers.

Figure 1:
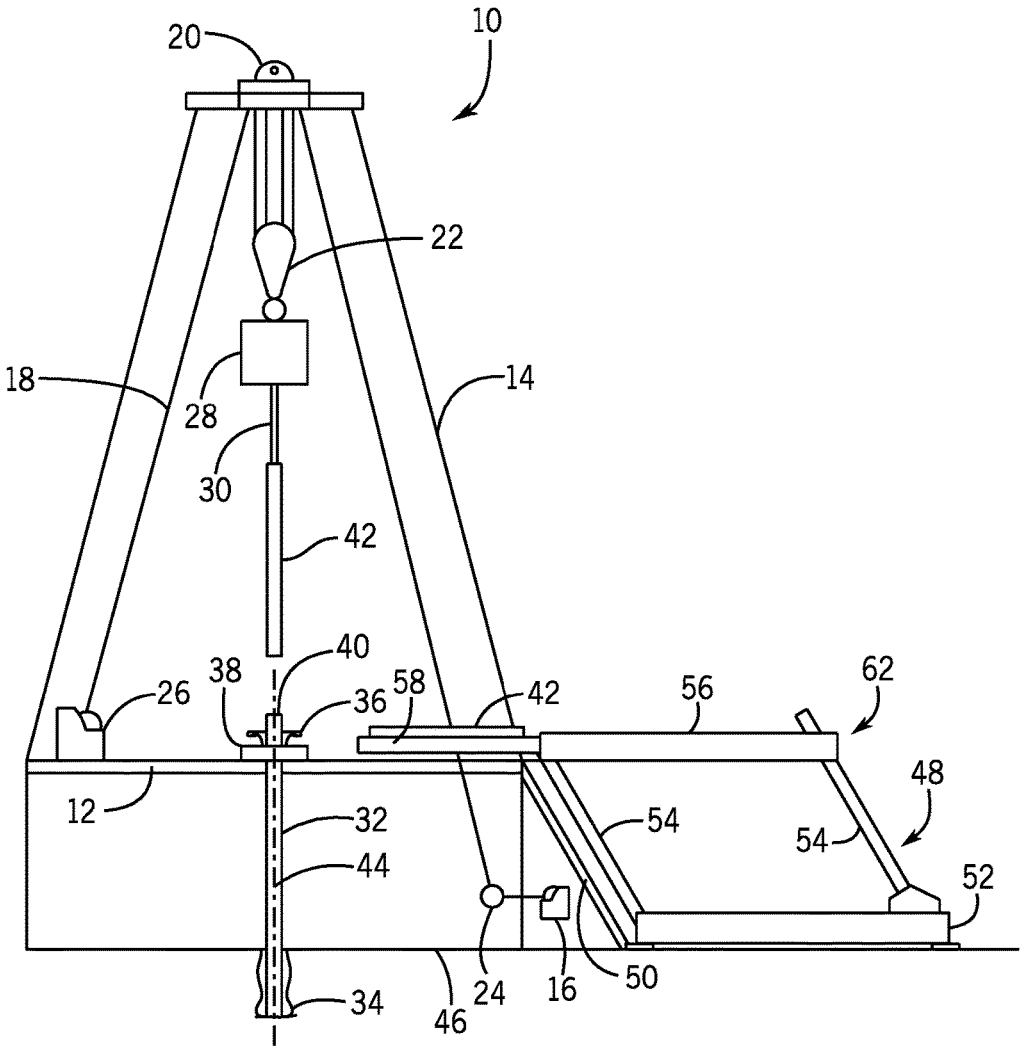
FIG. 1 is a schematic representation of a well being drilled in accordance with an embodiment of the present techniques.

Turning now to the drawings, FIG. 1 is a schematic representation of a drilling rig 10 (e.g., a land-based drilling rig) in the process of drilling a well in accordance with an embodiment of the present disclosure. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. The traveling block 22 supports a top drive 28, which features a quill 30 used to turn tubular or other drilling equipment. Below the rig floor 12, a tubular string 32 extends downward into a wellbore 34 and is held stationary with respect to the rig floor 12 by a spider or slips 36 of a rotary table 38. A portion of the tubular string 32 extends above the rig floor 12, forming a stump 40 to which another tubular element 42 (e.g., a joint of drillpipe) is in the process of being added.

In the illustrated embodiment, the top drive 28 is hoisting the tubular element 42 to a vertically aligned position over well center. That is, the tubular element 42 is aligned with a vertical axis 44 that passes through the center of the wellbore 34. When the tubular element 42 is aligned with well center, it is also aligned with the center of the quill 30, the stump 40, and the tubular string 32 extending into the wellbore 34. From this position, the tubular element 42 can be lowered (e.g., stabbed) onto the stump 40, rotated to form the connection, and eventually lowered into the wellbore 34.

Before the tubular element 42 can be brought into alignment with the axis 44, the tubular element 42 may be transported from a position near a ground surface 46 to a position near the rig floor 12 using presently disclosed techniques. From the position near the rig floor 12, the tubular element 42 may be engaged by the top drive 28, or by elevators coupled to the top drive 28. In presently disclosed embodiments, the tubular element 42 is transported to the rig floor 12 via a catwalk system 48. The catwalk system 48 is a positive drive pipe conveyor system that may be used to transport tubular elements 42 from the ground surface 46 to the rig floor 12 (e.g., during rig up operations) and from the rig floor 12 to the ground surface 46 (e.g., during laydown operations).

As shown, the catwalk system 48 is positioned on the ground surface 46 but is independent of the drilling rig 10. Indeed, the catwalk system 48 does not utilize or interfere with any component of the drilling rig 10. For example, a V-door 50 of the drilling rig 10 is not used or blocked by the catwalk system 48. Thus, the V-door 50 may be used even when the catwalk system 48 is positioned and deployed next to the drilling rig 10.

As shown, the catwalk system 48 includes a base 52 and columns 54 extending from the base 52, which support a carriage and trough assembly 56. As mentioned above, the carriage and trough assembly 56 (which includes a conveyor 58) may be supported by the columns 54. The carriage and trough assembly 56, on which a tubular element 42 may be positioned, may be raised and guided along the columns 54 (e.g., with tracks or other guiding/retaining features) in a substantially horizontal orientation (e.g., plus or minus 0 to 20, 1 to 15, 2 to 10, or 3 to 5 degrees). When the carriage and trough assembly 56 is raised above the rig floor 12, the conveyor 58 and/or trough of the catwalk system 48 may be extended over, or at least partially over, the rig floor 12. As shown, the columns 54 may be angled toward the drilling rig 10 (e.g., prior to the carriage and trough assembly 56 being lifted) to reduce the distance that the conveyor 58 and/or trough must be extended toward the rig floor 12. Once the carriage and trough assembly 56 is in a lifted position 62, as shown in FIG. 1, the conveyor 58 is operated to deliver the tubular element 42 onto the rig floor 12. For example, the conveyor 58 may be or include a belt and/or apron feeder that is rotated or driven to move the stationary tubular element 42 onto the rig floor 12. Indeed, the tubular element 42 may remain stationary relative to the belt or apron of the conveyor 58 to reduce abrasion between the tubular element 42 and the conveyor 58. As a result, unintentional wear to the tubular element 42 (e.g., threads of the tubular element 42) may be reduced. In other embodiments, the carriage and trough assembly 56 may include a pipe skate (e.g., pipe slide) to direct the tubular element 42 to the rig floor 12 in addition to, or in lieu, of the conveyor 58.

It should be noted that the illustration of FIG. 1 is intentionally simplified to focus on the catwalk system 48 described in detail below. Many other components and tools may be employed during the various periods of formation and preparation of the well. In some embodiments, for example, the illustrated top drive 28 may be replaced by a swivel in a drilling rig 10 that utilizes a kelly drive to turn the tubular string 32. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs.

Figure 2:
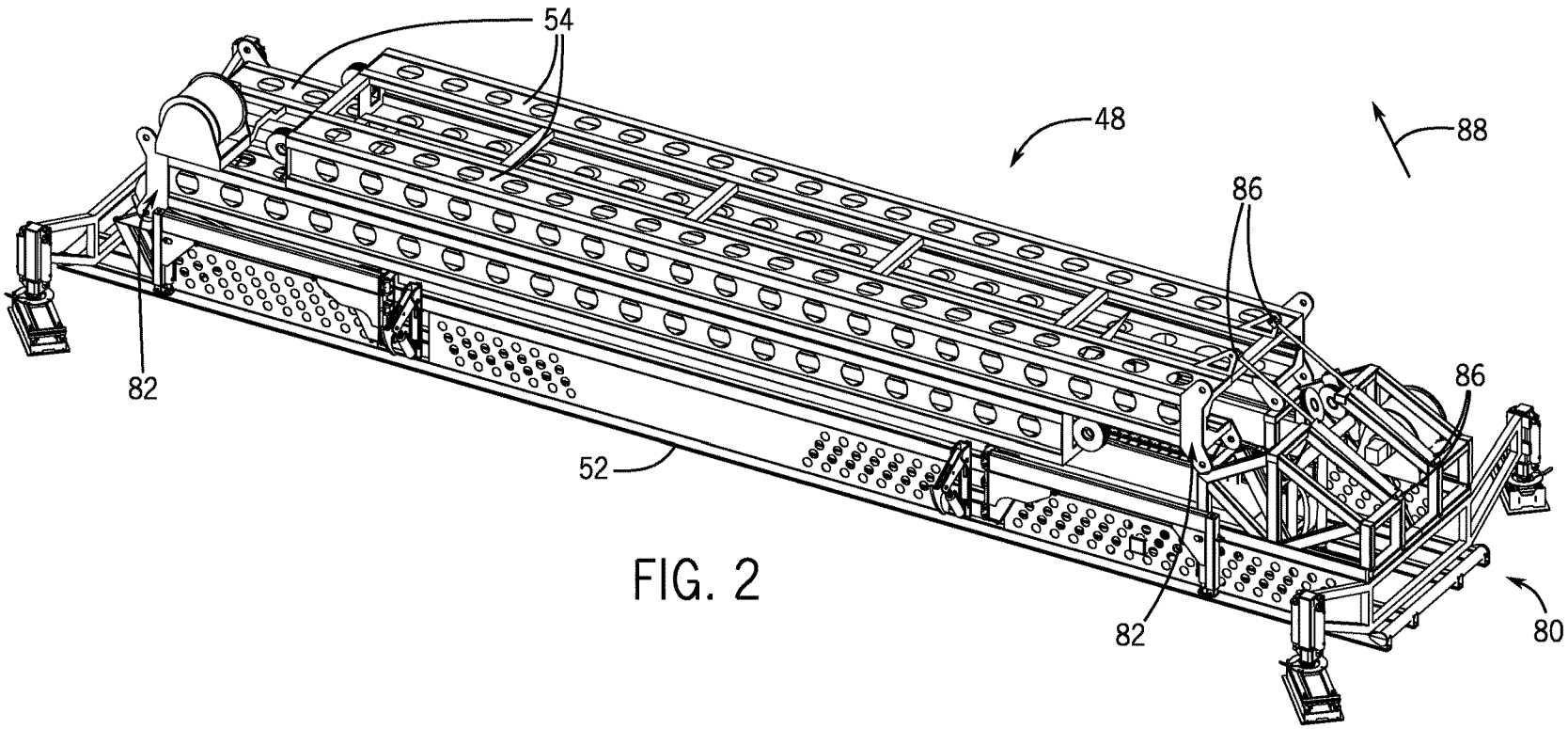
FIG. 2 is a perspective view of a catwalk system in a retracted or folded position, in accordance with an embodiment of the present techniques.

FIGS. 2-18 are views illustrating certain aspects of the catwalk system 48. For example, FIG. 2 illustrates an embodiment of the catwalk system 48 in a folded or closed configuration 80. The catwalk system 48 may be folded as shown in FIG. 2 when the catwalk system 48 is not in use and/or is being transported to or from a drilling rig 10 location. In certain embodiments, the catwalk system 48 may be transported via a flat bed truck or trailer. As mentioned above, the columns 54 (e.g., posts) may be coupled to the base 52 of the catwalk system 48 via hinged connections 82. In other embodiments, the columns 54 may be separate components that are inserted into slots or recesses of the base to secure the columns or posts in an erected configuration.

As shown in the illustrated embodiment of FIG. 2, the catwalk system 48 also includes one or more braces 84 that may provide support to the columns 54 when the columns 54 are in the extended position 62. For example, the braces 84 may be coupled to the columns 54 and the base 52 of the catwalk system 48. In certain embodiments, the braces 84 may be coupled to the columns 54 and/or the base 52 via hinged connections 86. Accordingly, when the columns 54 are in the folded configuration 80, the braces 84 may similarly be folded, such that the catwalk system 48 is relatively compact, thereby facilitating transportation of the catwalk system 48. Further, as the columns 54 of the catwalk system 48 are maneuvered in a direction 88 toward the extended position 62, the braces 84 may also move in the direction 88. When the columns 54 reach the extended position 62, the braces 84 may lock (e.g., via a bolt or other securement feature), such that the columns 54 are blocked from inadvertently moving (e.g., back toward the folded position 80).

Figure 3:
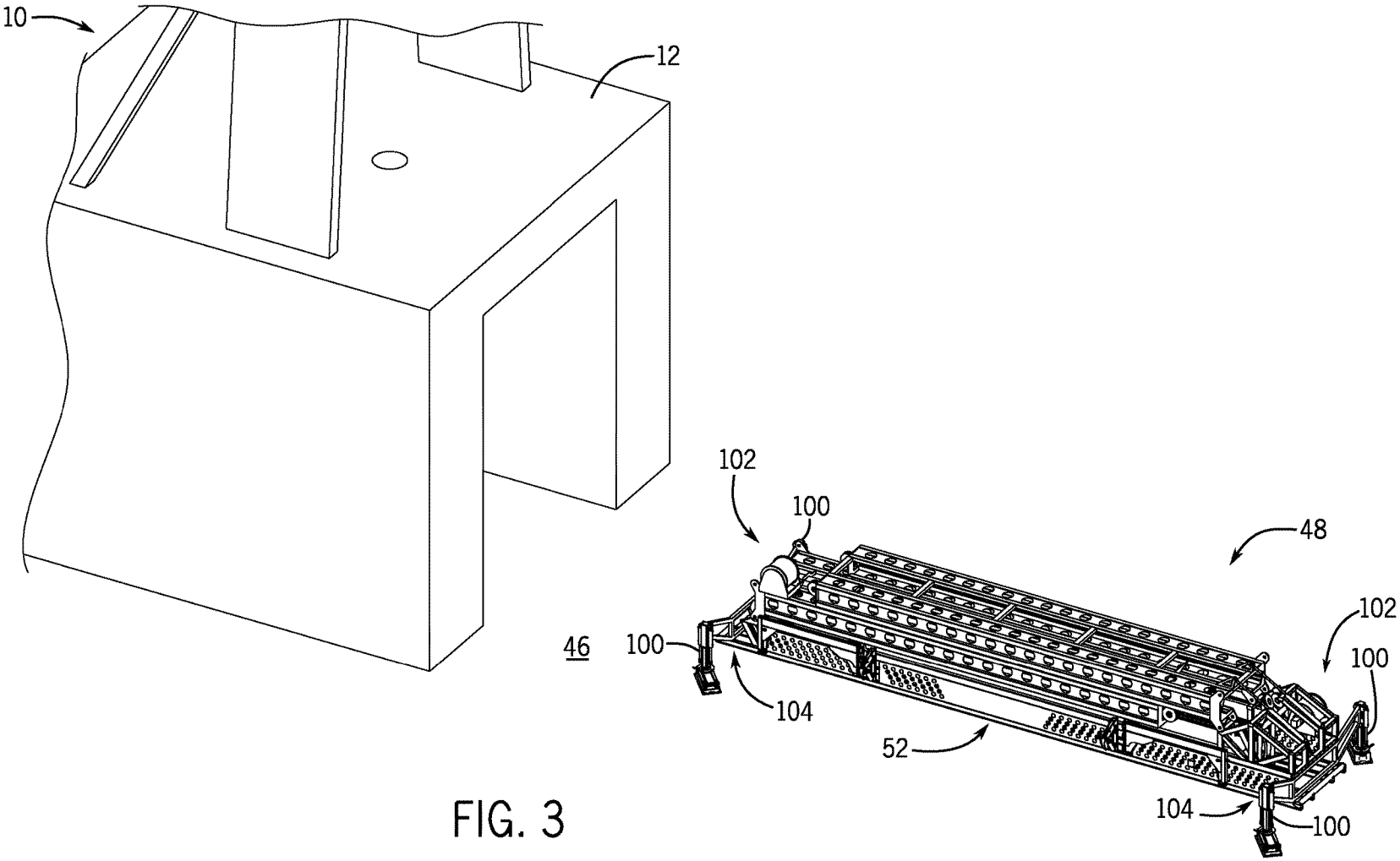
FIG. 3 is a perspective view of a catwalk system in a retracted or folded position adjacent to a drilling rig, in accordance with an embodiment of the present techniques.

FIG. 3 shows the catwalk system 48 positioned near the drilling rig 10. As mentioned above, the catwalk system 48, when in use, is independent from the drilling rig 10. As such, the catwalk system 48 may not be coupled or engaged with the drilling rig 10 or its components. As shown in FIG. 3, stabilizers 100 of the catwalk system 48 are in a deployed configuration 102. The stabilizers 100 may secure and stabilize the catwalk system 48 in place on the ground surface 46. For example, the stabilizers 100 may decrease a height to base width ratio of the catwalk system 48 (e.g., by increasing a base, width, or area), thereby providing enhanced support to block the catwalk system 48 from tipping.

As shown in the illustrated embodiment of FIG. 3, at least one end 104 of each of the stabilizers 100 may be coupled to the base 52 and/or the braces 84 of the catwalk system 48. When it is desired to extend the columns 54 into the extended position 62, the stabilizers 100 may be pivoted away from the base 52, such that the base 52 includes additional contact points with the ground surface 46 (e.g., four additional contact points). Increasing the amount of contact points with the ground surface 46 may provide additional support to the catwalk system 48 when the columns 54 are in the extended position 62 and when the catwalk system 48 is in use.

Figure 4:
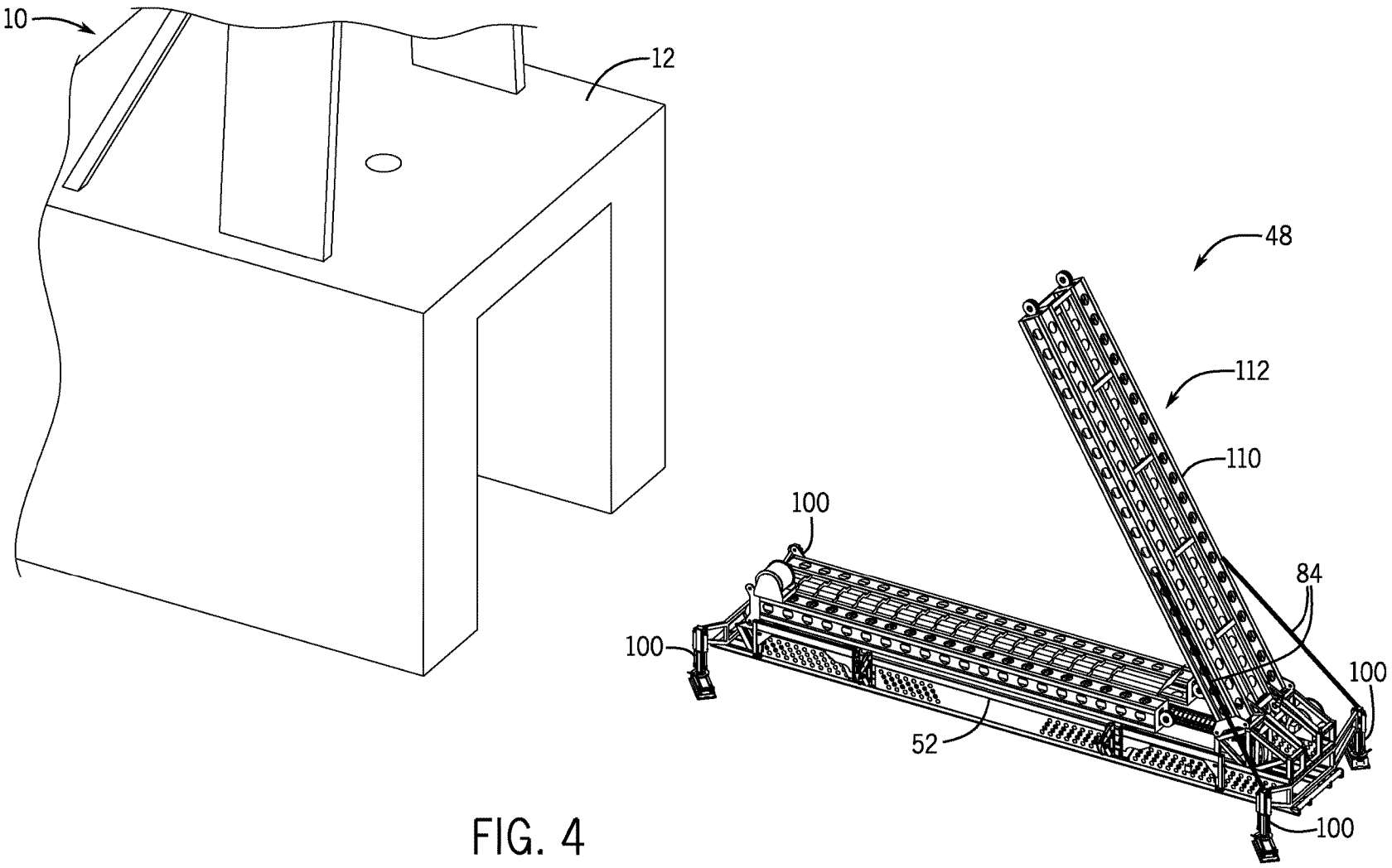
FIG. 4 is a perspective view of a catwalk system in a partially deployed position, in accordance with an embodiment of the present techniques.

FIG. 4 illustrates the catwalk system 48 with a rear column 110 (e.g., a rear leg) of the catwalk system 48 in a deployed, raised, or lifted configuration 112. In the illustrated embodiment of FIG. 4, the rear column 110 is a fixed truss or other support structure. Although described throughout the present disclosure as a single structure, the rear column 110 may include two separate columns or other structures coupled to one another. In any case, the rear column 110 does not include multiple members that move relative to one another. Instead, the entire rear column 110 rotates relative to the base 52 to move from the folded position 80 to the extended position 62 (e.g., a single adjustment may move the rear column 110 from the folded position to the extended position 62). Once the rear column is unfolded or extended, a front column 114 (e.g., a front leg) of the catwalk system 48 may be unfolded and extended, as shown in FIG. 5.

Figure 5:
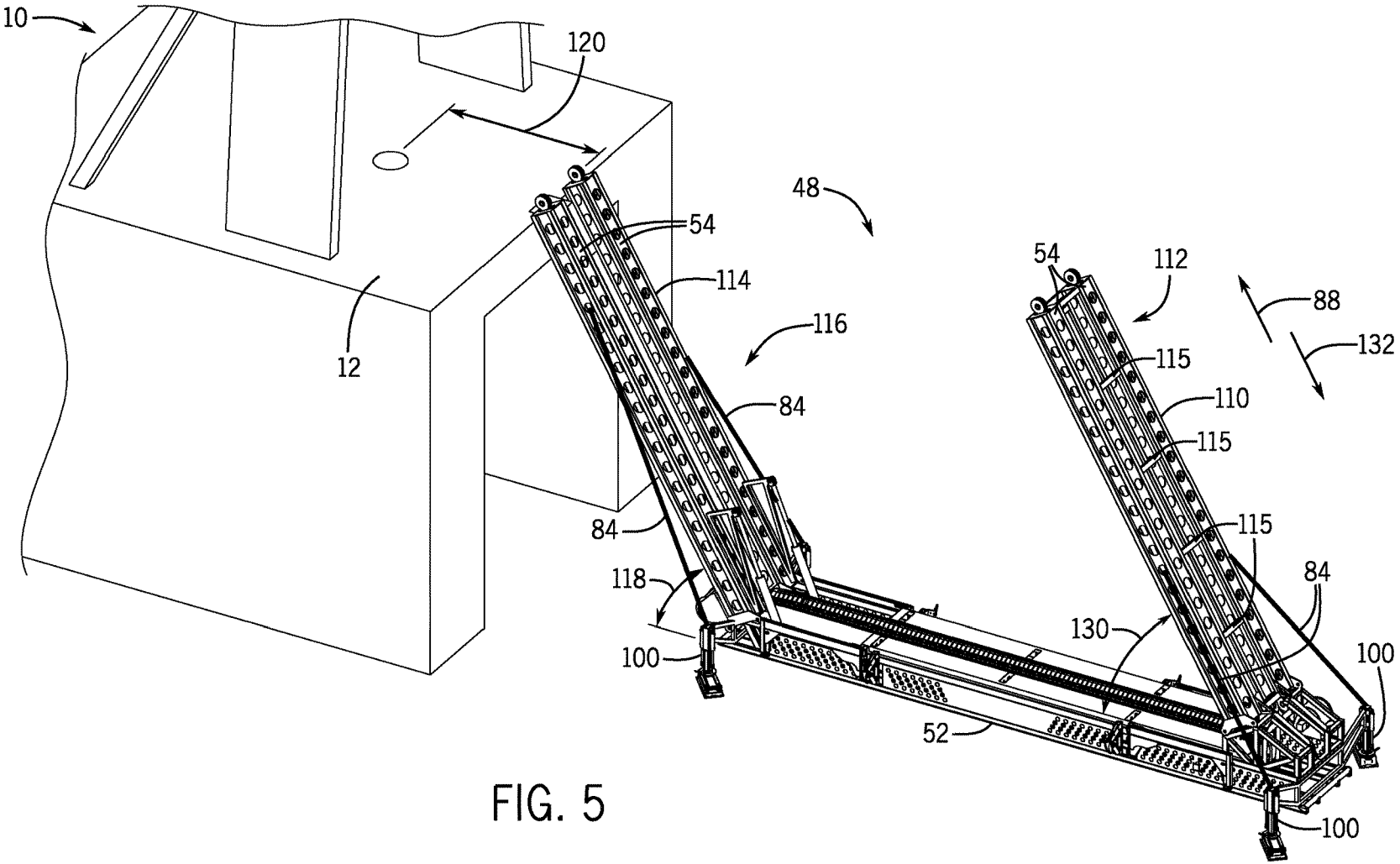
FIG. 5 is a perspective view of a catwalk system in a deployed position, in accordance with an embodiment of the present techniques.

Specifically, as shown in the illustrated embodiment of FIG. 5, the front column 114 is similar to the rear column 110 in that it is a fixed truss or structure that rotates relative to the base 52. Although described throughout the present disclosure as a single structure, the front column 114 may include two separate columns or other structures coupled to one another. However, in any case, the front column 114 does not include multiple members that move relative to one another during operation of the catwalk system 48 (e.g., conveyor 58). As shown in the illustrated embodiment of FIG. 5, the front column 114 and/or the rear column 110 may include cross-bracing 115 that couples one or more portions of the front column 114 to one another and/or one or more portions of the rear column 110 to one another. The cross-bracing 115 may provide additional support to the catwalk system 48. However, in other embodiments, the cross-bracing 115 may be removed, such that the catwalk system 48 may be reach a wider range of rig floor 12 heights. Embodiments that do not include the cross-bracing 115 are discussed in more detail herein with reference to FIGS. 21-23.

The front column 114 may be deployed in an angled position 116. That is, the front column 114 is angled toward the drilling rig 10 and forms an angle 118 with the base 52 of the catwalk system 48. In certain embodiments, the angle 118 may be between 10 and 88 degrees, between 20 and 75 degrees, between 40 and 60 degrees, or any other suitable range. As mentioned above, the configuration of the columns 54 may reduce a distance 120 that the conveyor 58 and/or trough extends to reach the wellbore 34 during operation of the conveyor 58. In certain embodiments, the front 114 and rear 110 columns may be deployed from the folded position 80 shown in FIG. 2 by a crane or other suitable method (e.g., via actuators configured to move the columns 54 in the direction 88). As mentioned above, in certain embodiments, the columns 54 may be coupled to the catwalk system 48 via the hinged connections 82 between the columns 54 and the base 52. However, in other embodiments, the columns 54 may have other types of connections.

While the illustrated embodiment of the front 114 and rear 110 columns are fixed trusses, other embodiments of the columns 54 may have other configurations. For example, the front 114 and rear 110 columns may include telescoping segments that are nested within one another. The telescoping segments may then be extended and pinned relative to one another to create fixed column structures. Similarly, the columns 54 may include foldable segments that fold relative to one another in a retracted state (e.g., the folded position 80), and the foldable segments may be unfolded and pinned or otherwise fixed to create rigid columns that may be erected. Once the columns 54 are in the extended position 62, the segments of the column may no longer pivot relative to one another to create rigid supports for the carriage and trough assembly 56.

As shown in FIG. 5, the rear column 110 of the catwalk system 48 may also be angled toward the drilling rig 10, e.g., forming an angle 130 with the base 52 similar to the angle 118 between the front column 114 and the base 52. For example, the angle 130 may be between 10 and 88 degrees, between 20 and 75 degrees, between 40 and 60 degrees, or any other suitable range. The angles 118 and 130 may enable translation of the carriage and trough assembly 56 in an upward direction (e.g, the direction 88) and a downward direction 132 along the columns 54, as discussed in further detail below. Once the front 114 and rear 110 columns are unfolded and/or in a desired angled position (e.g., at the angles 118 and 130, respectively), the columns 54 may then be pinned in place. For example, at hinged connections 82 coupling the columns 54 to the base 52, pins or other retaining features may be used to fix the columns 54 in the deployed and/or the extended position 62, such that the columns 54 do not pivot relative to the base 52. In the illustrated embodiment of FIG. 5, the braces 84 are also used to secure and fix the columns 54 in place. Specifically, the braces 84 are coupled to the columns 54, the base 52, and/or the stabilizers 100 to hold the columns 54 in the erected and angled positions (e.g., the extended position 62).

Figure 6:
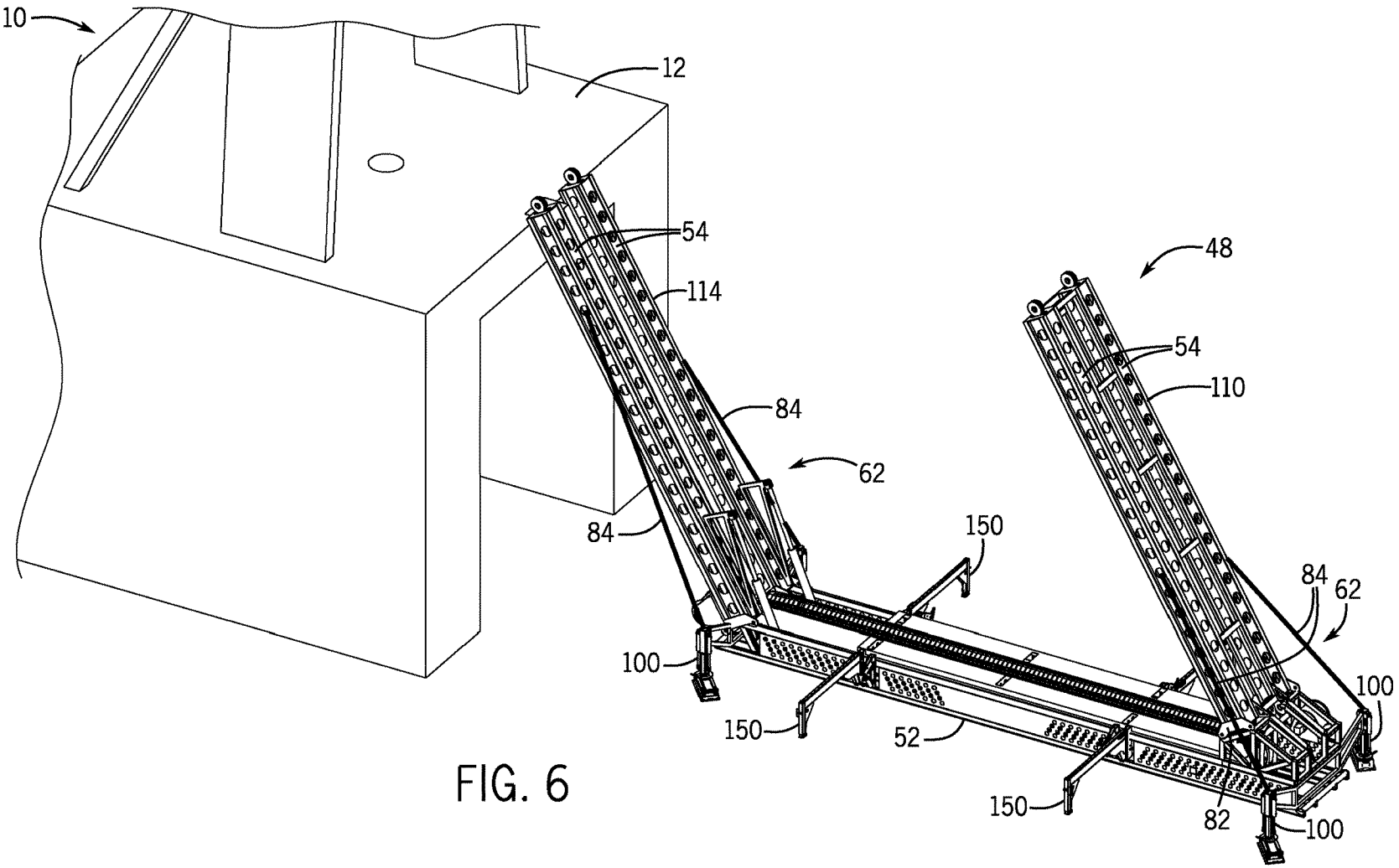
FIG. 6 is a perspective view of a catwalk system in a deployed position, in accordance with an embodiment of the present techniques.

After the columns 54 are secured in place, gullwings 150 (e.g., indexers) of the catwalk system 48 may be deployed, as shown in FIG. 6. The gullwings 150 may fold toward the base 52 when the catwalk system 48 is in the folded position 80. The gullwings 150 may be directed away from the base 52 when the catwalk system 48 is in the extended position 62, as shown in FIG. 6. As will be appreciated, the gullwings 150 may be used to support and or index/inventory tubular elements 42 to be lifted to the rig floor 12 by the catwalk system 48. Thereafter, one or more tubular elements 42 may be rolled onto the gullwings 150 and then onto the carriage and trough assembly 56 for lifting, as shown in FIGS. 7 and 8.

Figure 7:
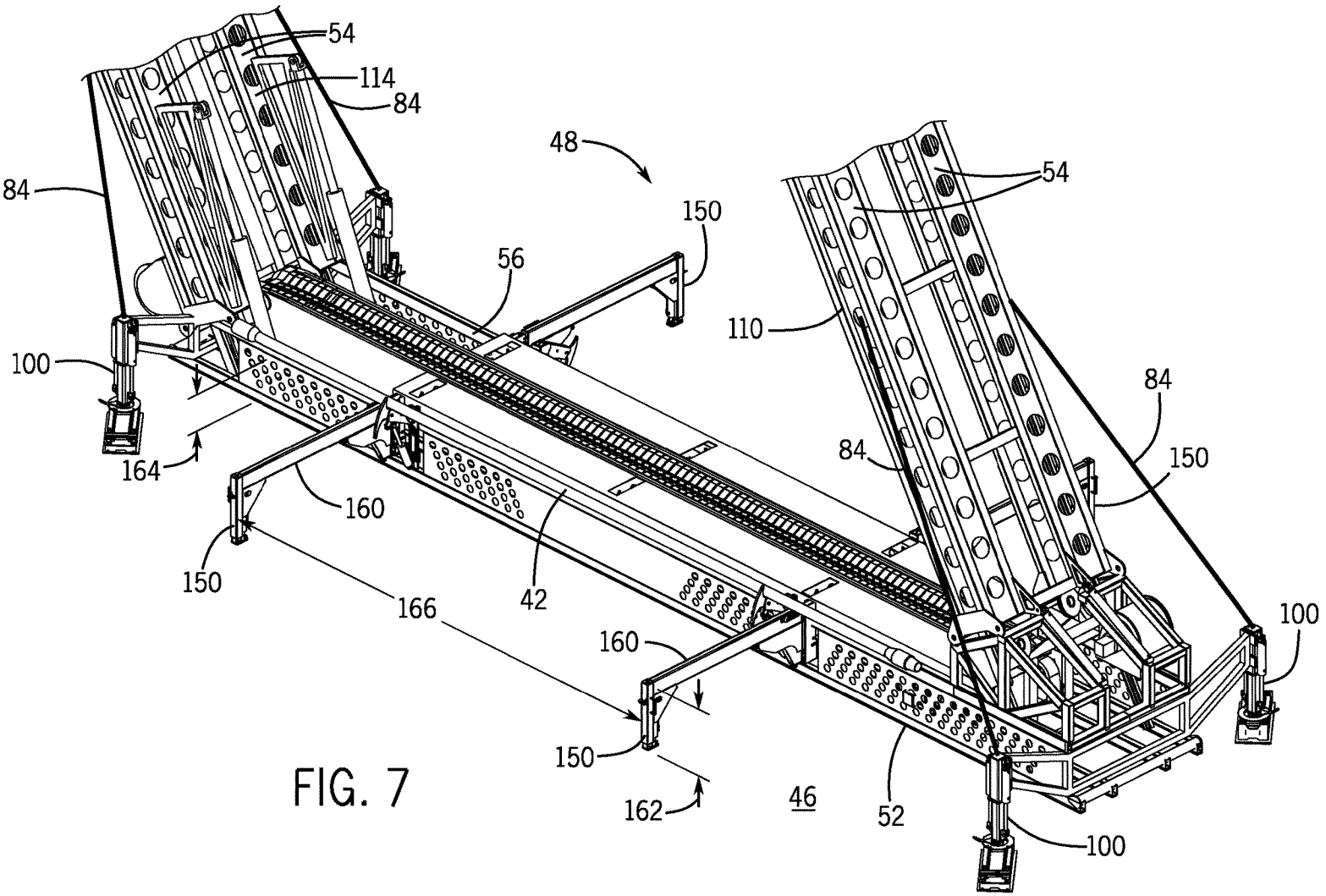
FIG. 7 is a partial perspective view of a catwalk system in a deployed position, in accordance with an embodiment of the present techniques.
Figure 8:
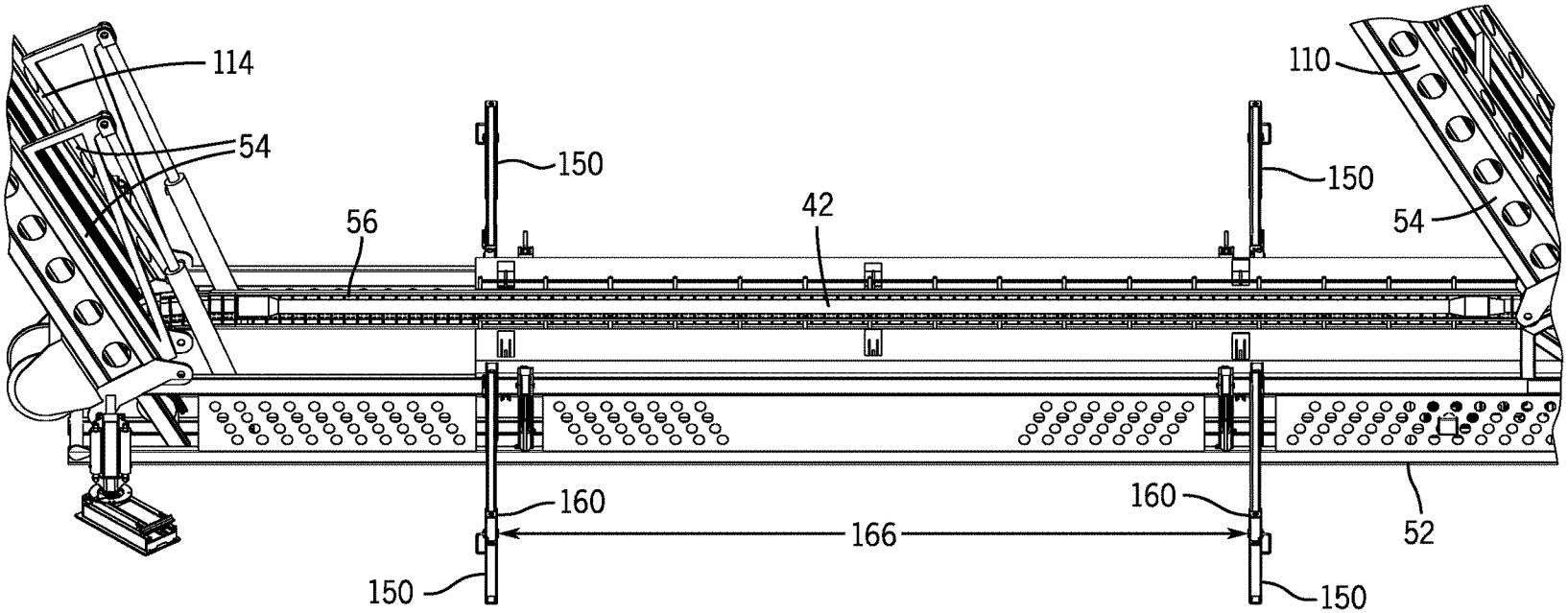
FIG. 8 is a partial perspective view of a catwalk system in a deployed position, in accordance with an embodiment of the present techniques.
Figure 9:
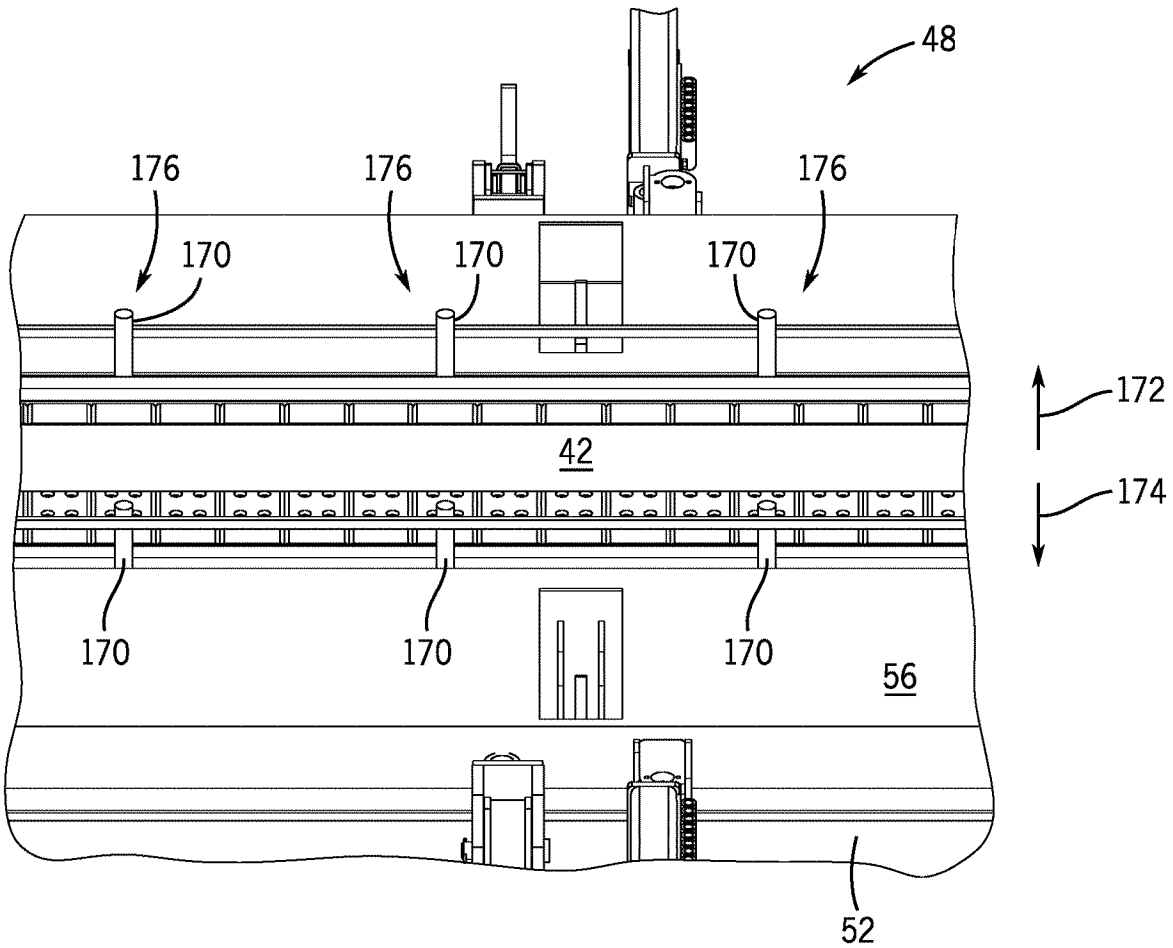
FIG. 9 is a partial perspective view of a catwalk system in a deployed position, in accordance with an embodiment of the present techniques.

For example, FIG. 7 is a partial perspective view of the catwalk system 48 in the extended position 62 when the gullwings 150 are deployed. As shown in the illustrated embodiment of FIG. 7, one tubular element 42 is positioned on a pair 160 of the gullwings 150. The pair of gullwings 160 enable an operator to place the tubular element 42 at a height 162 from the ground surface 46 that is substantially the same as a height 164 of the carriage and trough assembly 56 before it is lifted toward the rig floor 12. Accordingly, an operator may roll the tubular element 42 from the pair 160 of gullwings 150 toward the carriage and trough assembly 56 (e.g., FIG. 8). In certain embodiments, the pair 160 of gullwings 150 may facilitate placement of the tubular element 42 on the carriage and trough assembly 56. For example, an operator (e.g., via a crane) may position the tubular element 42 onto the pair 160 of gullwings 150 utilizing transport equipment (e.g., cables and/or ropes). The pair 160 of gullwings 150 may enable such transport equipment to be removed without obstruction (e.g., the pair 160 of gullwings 150 are separated by a space 166, which may allow the operator to remove transport equipment). Once the tubular element 42 is positioned on the carriage and trough assembly 56 for lifting, pins 170, as shown in FIG. 9, may be coupled to (or deployed from) the carriage and trough assembly 56 on either side of the tubular element 42. The pins 170 may help retain the tubular element 42 in place on the carriage and trough assembly 56 and/or block the tubular element 42 from inadvertently rolling off of the carriage and trough assembly 56 as the carriage and trough assembly 56 is hoisted or lifted toward the rig floor 12. For example, the pins 170 may block the tubular element 42 from moving in a first lateral direction 172 and/or a second lateral direction 174. In some embodiments, the pins 170 may be actuated to be raised into and out of position. For example, the pins 170 may be raised by an actuator or controller from a retracted position to a deployed position 176 within the carriage and trough assembly 56 or other component of the catwalk system 48. Similarly, the pins 170 may be lowered by the actuator or controller from the deployed position 176 toward the retracted position when it is desired to roll the tubular element 42 in the first lateral direction 172 and/or the second lateral direction 174 away from the carriage and trough assembly 56 (e.g., FIG. 15).

Figure 10:
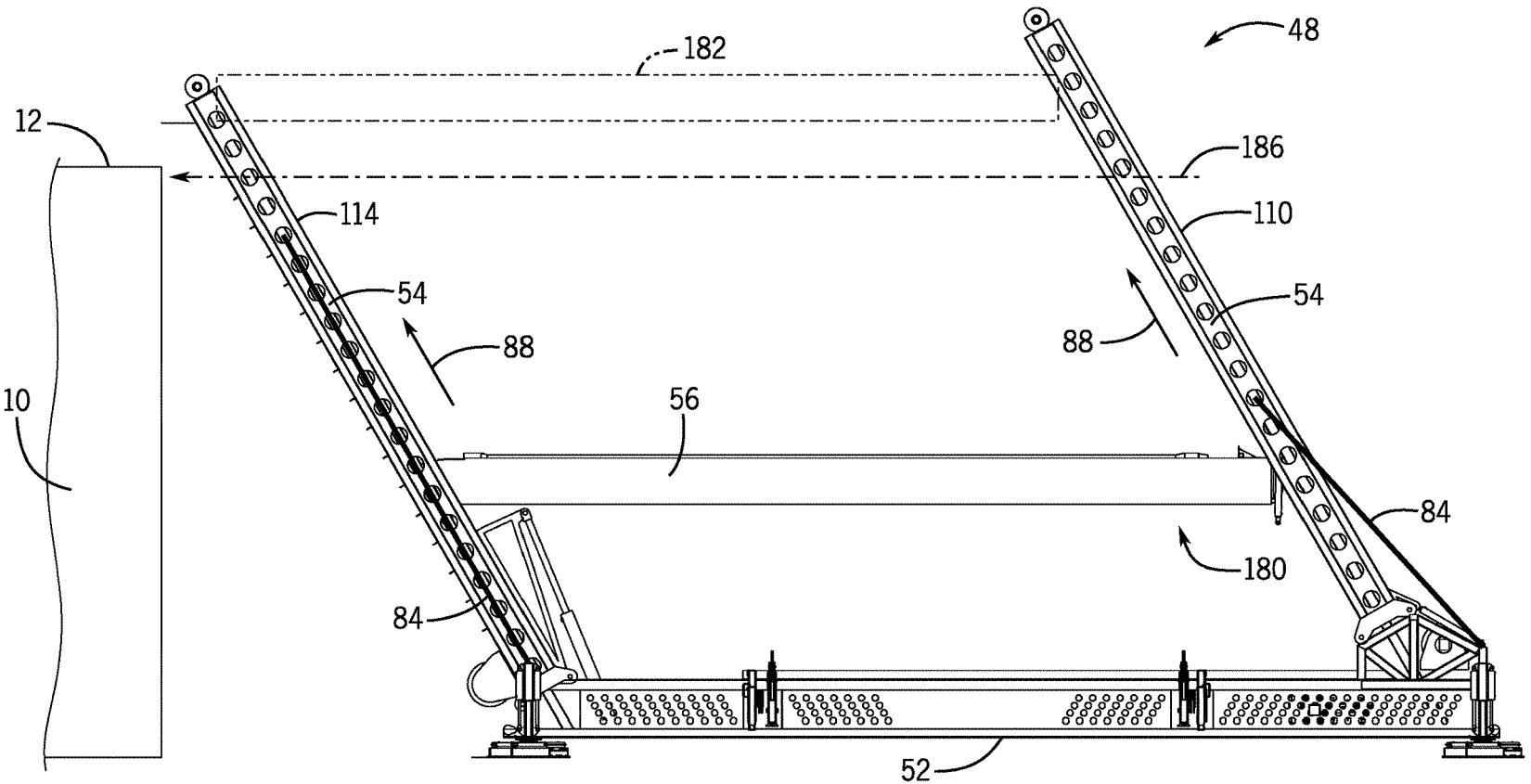
FIG. 10 is a side view of a catwalk system in a deployed position, illustrating a carriage and trough assembly in a partially raised position, in accordance with an embodiment of the present techniques.

With the tubular element 42 positioned and secured (e.g., via the pins 170) on the carriage and trough assembly 56, the carriage and trough assembly 56 may then be raised, as shown in FIG. 10. Specifically, the carriage and trough assembly 56 may be hoisted along the columns 54 in the direction 88. For example, cables and winches may be used with pulleys to lift the carriage and trough assembly 56 along the columns 54. In other embodiments, chains, gears, hydraulics, or another lifting mechanism may be used to raise the carriage and trough assembly 56. In certain embodiments, the columns 54 may have tracks or other guiding features to guide the carriage and trough assembly 56 along the columns 54 from a lowered position 180 to a raised position 182. As mentioned above, the carriage and trough assembly 56, and thus the tubular element 42, is raised in a substantially horizontal orientation (e.g., plus or minus 0 to 20, 1 to 15, 2 to 10, or 3 to 5 degrees). As the carriage and trough assembly 56 is raised (e.g., in the direction 88), the carriage and trough assembly 56 moves horizontally closer (e.g., along an axis 186) toward the drilling rig due to the angled configuration of the columns 54. While the illustrated embodiment of FIG. 10 shows the carriage and trough assembly 56 above the rig floor 12 when in the raised position 182, it should be recognized that, in other embodiments, the carriage and trough assembly 56 may be substantially flush with the rig floor 12 when in the raised position 182.

Figure 11:
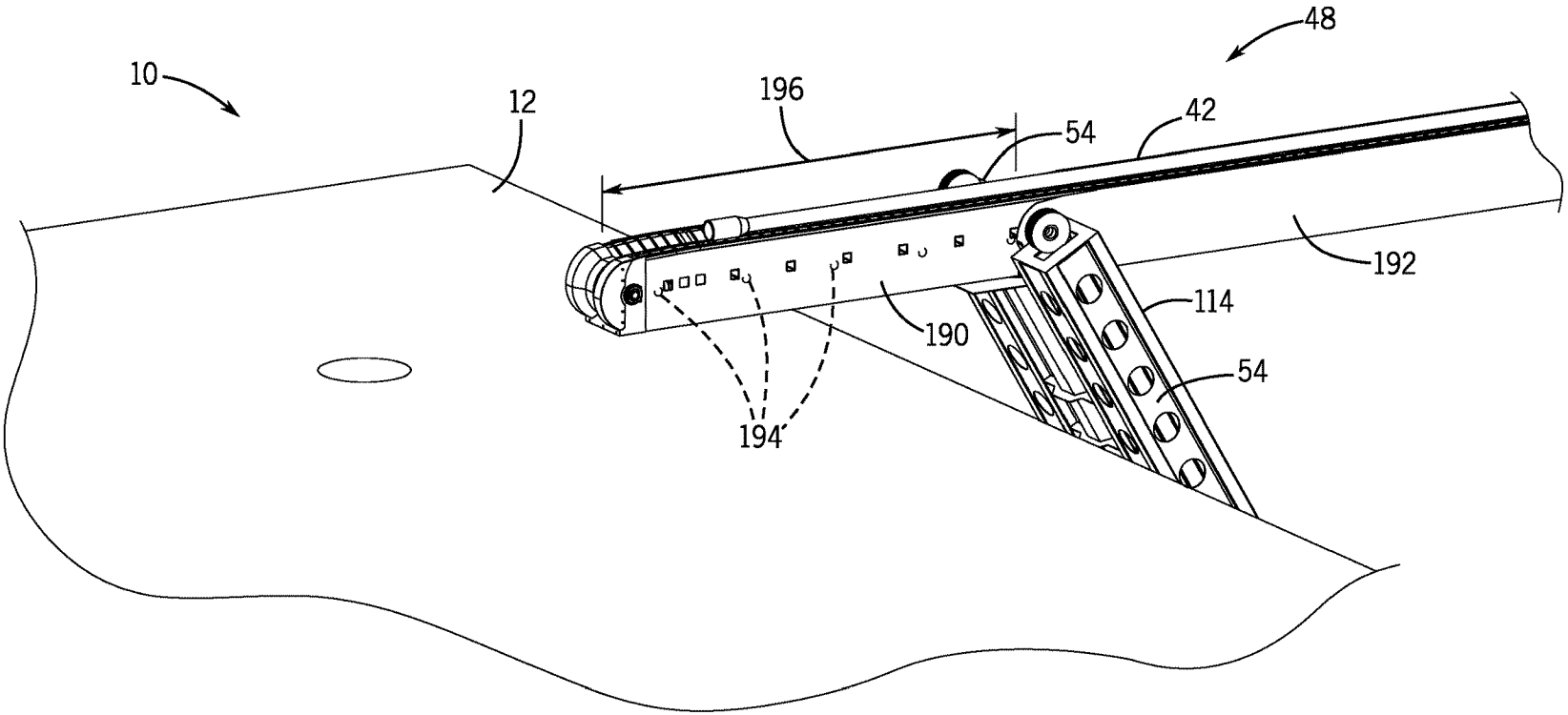
FIG. 11 is a partial perspective view of a catwalk system, illustrating the carriage and trough assembly in a raised position and a trough in an extended position, in accordance with an embodiment of the present techniques.

Once the carriage and trough assembly 56 is in the raised position 182 (i.e., above the rig floor 12), a trough 190 of the carriage and trough assembly 56 may be horizontally extended from a carriage 192 of the carriage and trough assembly 56, such that the trough 190 is positioned over the drilling rig floor 12, as shown in FIG. 11. For example, the carriage and trough assembly 56 may include sliding elements 194 (e.g., rollers, bearings, tracks, and/or other mechanisms) to enable relative movement between the carriage 192 and the trough 190. As the trough 190 is moved over the drilling rig floor 12, the tubular element 42 is also horizontally translated over the rig floor 12. However, the tubular element 42 does not move relative to the trough 190. Instead, the tubular element 42 remains stationary relative to the trough 190, thereby reducing potential wear on the tubular element 42 (e.g., threads of the tubular element). Furthermore, as mentioned above, the angled orientation of the columns 54 reduces a distance 196 by which the trough 190 is extended from the carriage 192, thereby reducing forces (e.g., bending moments) acting on the trough 190 and/or the carriage 192.

Figure 12:
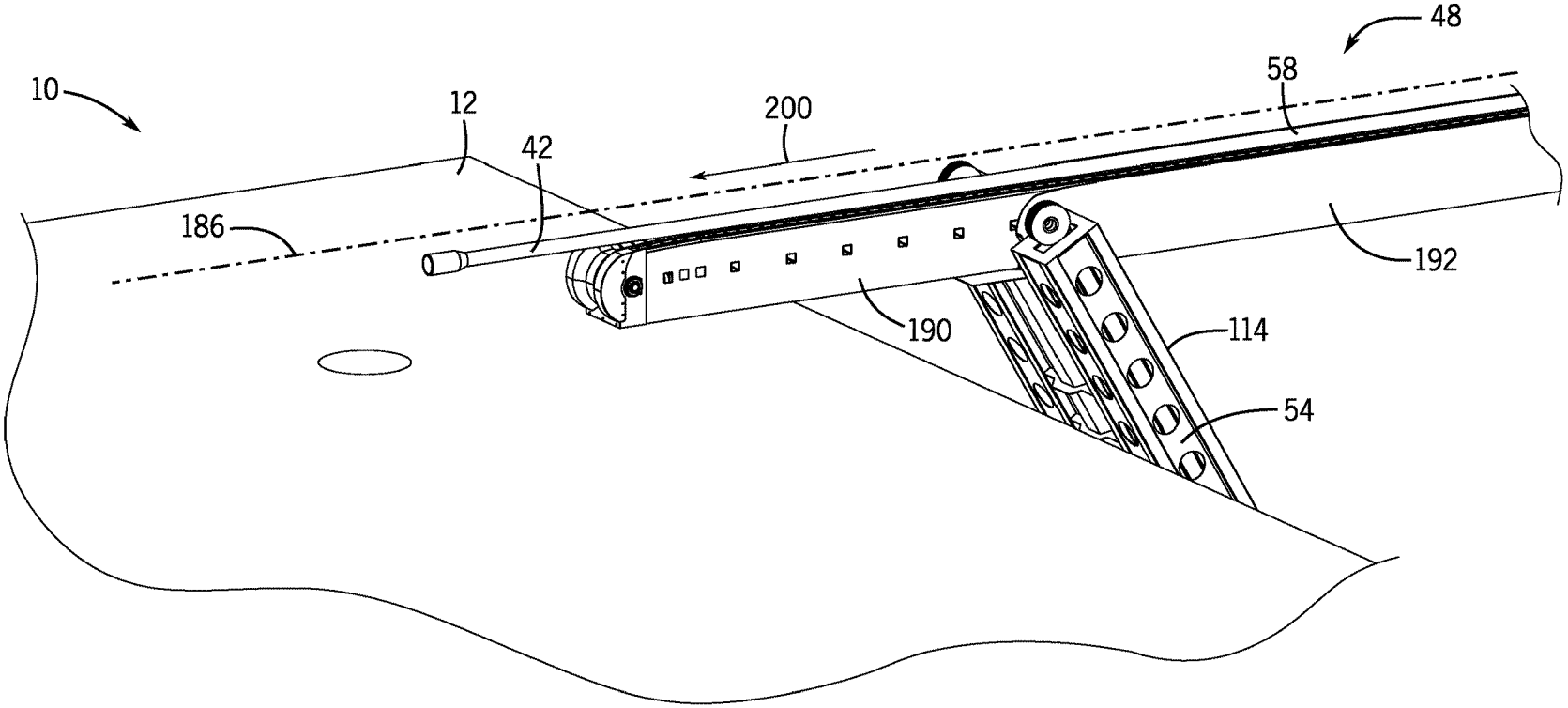
FIG. 12 is a partial perspective view of a catwalk system, illustrating the carriage and trough assembly in a raised position and a trough in an extended position, in accordance with an embodiment of the present techniques.

After the trough 190 is extended horizontally from the carriage 192 such that the trough 190 is at least partially over the rig floor 12, the conveyor 58 of the trough 190 may be actuated to horizontally translate the tubular element 42 along the axis 186 in a direction 200 toward the rig floor 12, as shown in FIG. 12. For example, the conveyor 58 may be or include one or more belts, apron feeders, plates, belt segments, or another suitable surface that may support and transfer the tubular element 42 onto the rig floor 12. In certain embodiments, the conveyor 58 may include one or more surface treatments or features, such as treads, knurls, or other features, to maintain a gripping engagement between the conveyor 58 and the tubular element 42. In this way, the tubular element 42 may be horizontally translated in the direction 200 by the conveyor 58 without the tubular element 42 moving relative to the belt or apron of the conveyor 58 (e.g., to reduce potential wear on the tubular element 42). Once the tubular element 42 is at least partially extending from the conveyor 58 over the rig floor 12, the tubular element 42 may be gripped by another component of the drilling rig 10 such as elevators (not shown). As will be appreciated, the horizontal orientation of the tubular element 42 as the tubular element 42 is delivered onto the rig floor 12 may reduce the complexity of gripping or otherwise manipulating the tubular element 42 with the elevators or other lifting device. Additionally, the conveyor 58 (e.g., a continuous belt or apron) may not be returned to a starting position (e.g., reset) because the conveyor 58 may be configured to stop at any position and then resume operation from that position. In other embodiments, the carriage and trough assembly 56 may include a pipe skate (e.g., pipe slide) to direct the tubular element 42 to the rig floor 12 in addition to, or in lieu of, the conveyor 58.

Figure 13:
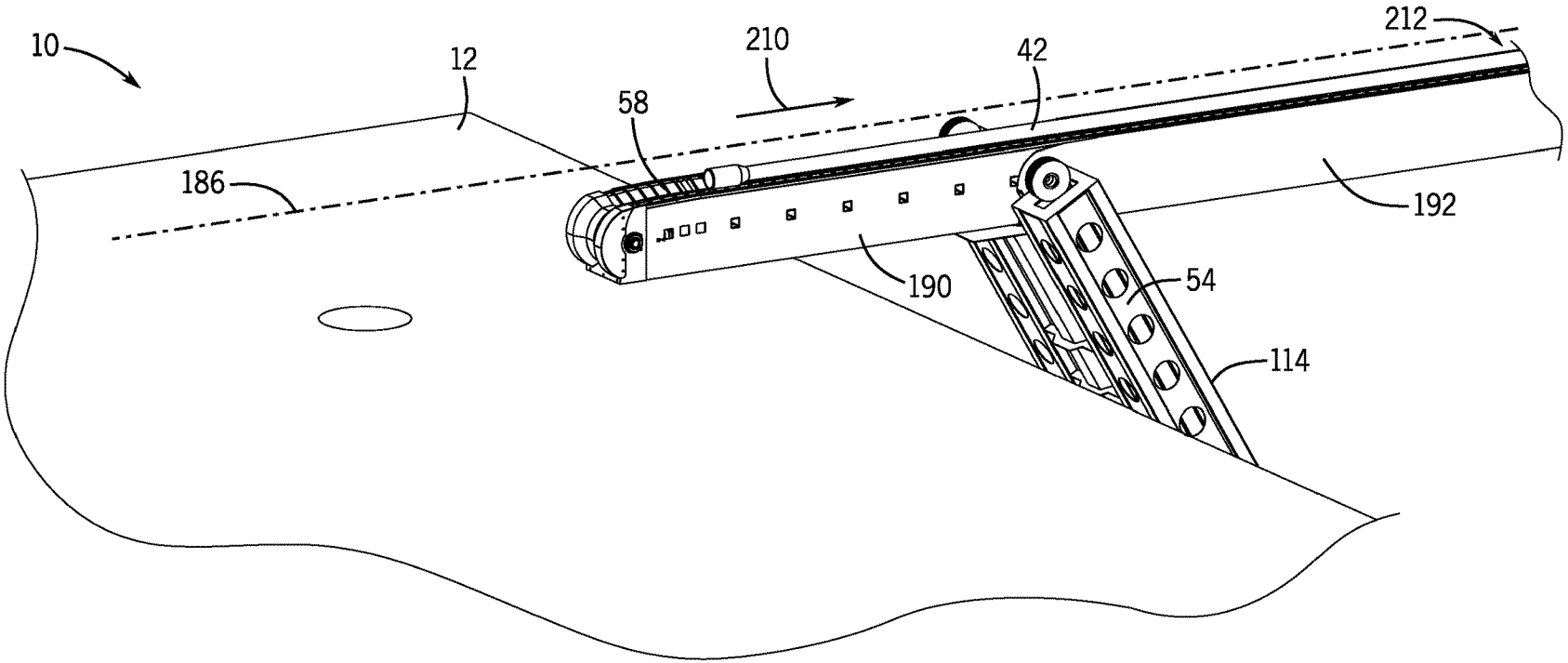
FIG. 13 is a partial perspective view of a catwalk system, illustrating the carriage and trough assembly in a raised position and a trough in an extended position, in accordance with an embodiment of the present techniques.
Figure 14:
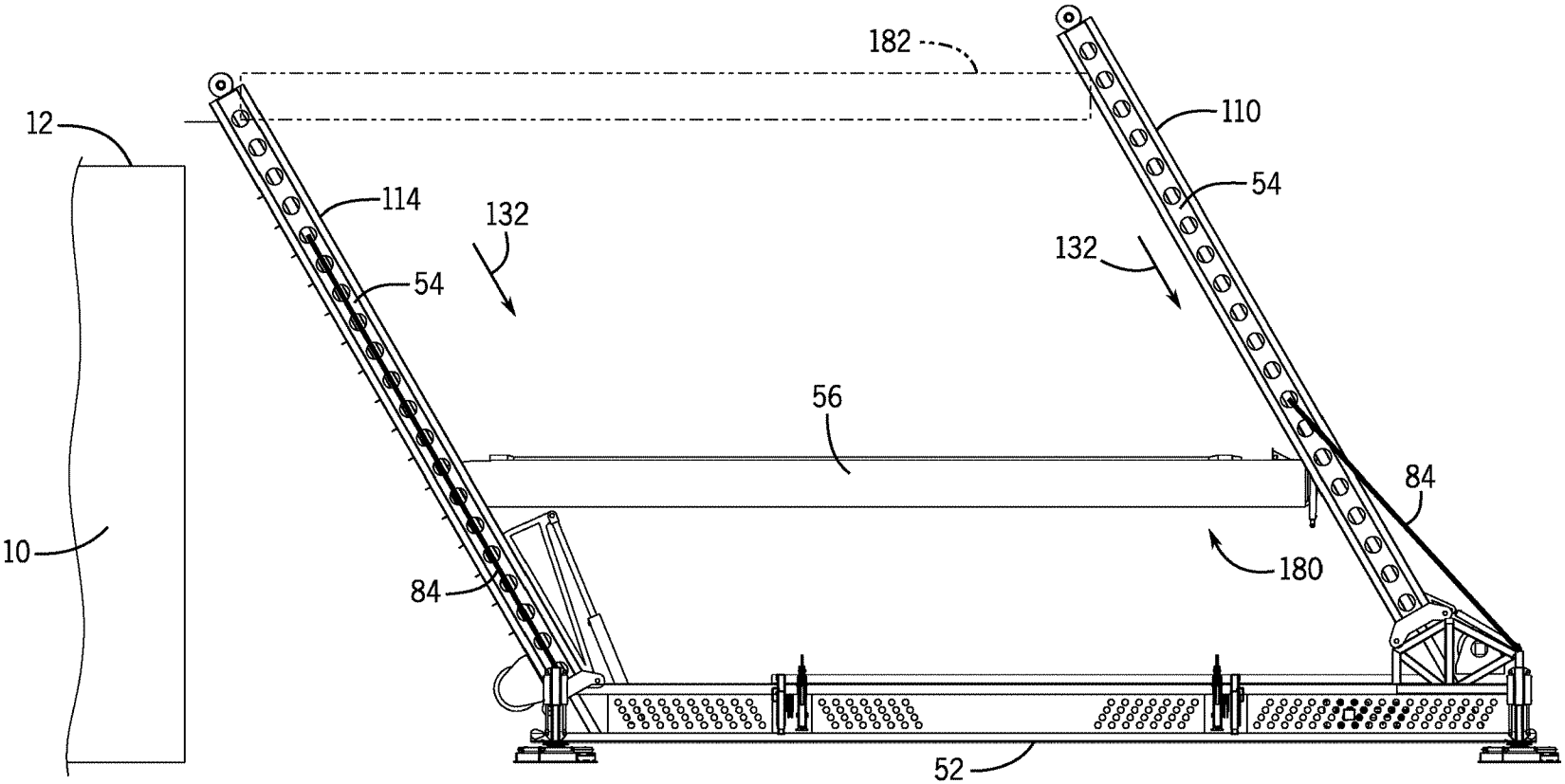
FIG. 14 is a side view of a catwalk system, illustrating the carriage and trough assembly in a partially raised position, in accordance with an embodiment of the present techniques.

The conveyor 58 may also be operated to accept a tubular element 42 onto the trough 190 and the carriage 192. In other words, as shown in FIG. 13, the conveyor 58 may be operated in a direction 210 opposite the direction 200 along the axis 186 to guide the tubular element 42 off of the rig floor 12 and back onto the trough 190. For example, elevators (not shown) of the drilling rig 10 may be used to place the tubular element 42 at least partially onto the trough 190, and the conveyor 58 of the trough 190 may then be operated to guide the tubular element 42 onto the trough 190. Specifically, the tubular 42 may be lowered vertically (e.g., via the elevators), such that a first end 212 of the tubular element 42 contacts the conveyor 58 operating in reverse mode. In this manner, the conveyor 58 may guide the tubular element 42 from a vertical orientation (e.g., vertical with respect to the axis 186) into a substantially horizontal orientation onto the trough 190. Thereafter, the trough 190 may be retracted into the carriage 192. With the trough 190 retracted within the carriage 192, the carriage and trough assembly 56 may be lowered (e.g., via cables and winches) from the raised position 182 to the lowered position 180, as shown in FIG. 14. For example, FIG. 14 illustrates the carriage and trough assembly 56 in the lowered position 180 after moving in the direction 132 from the raised position 182.

Figure 15:
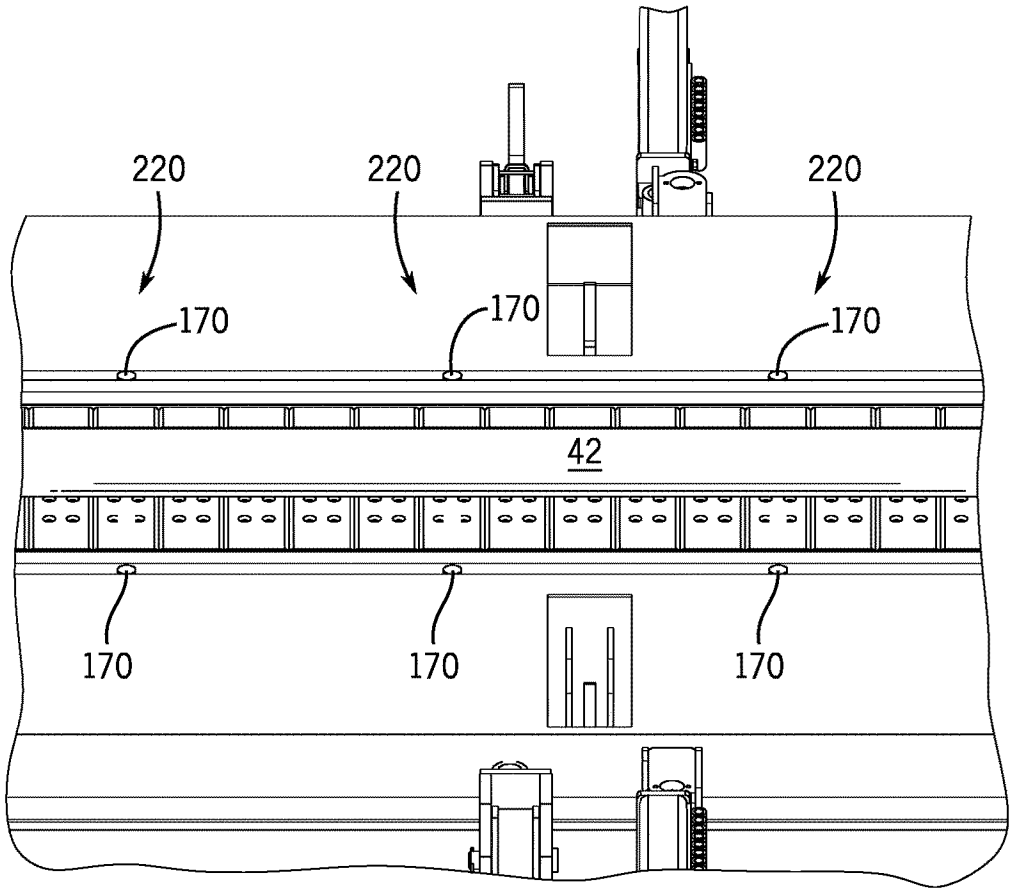
FIG. 15 is a partial perspective view of a catwalk system, illustrating the carriage and trough assembly in a lowered position, in accordance with an embodiment of the present techniques.
Figure 17:
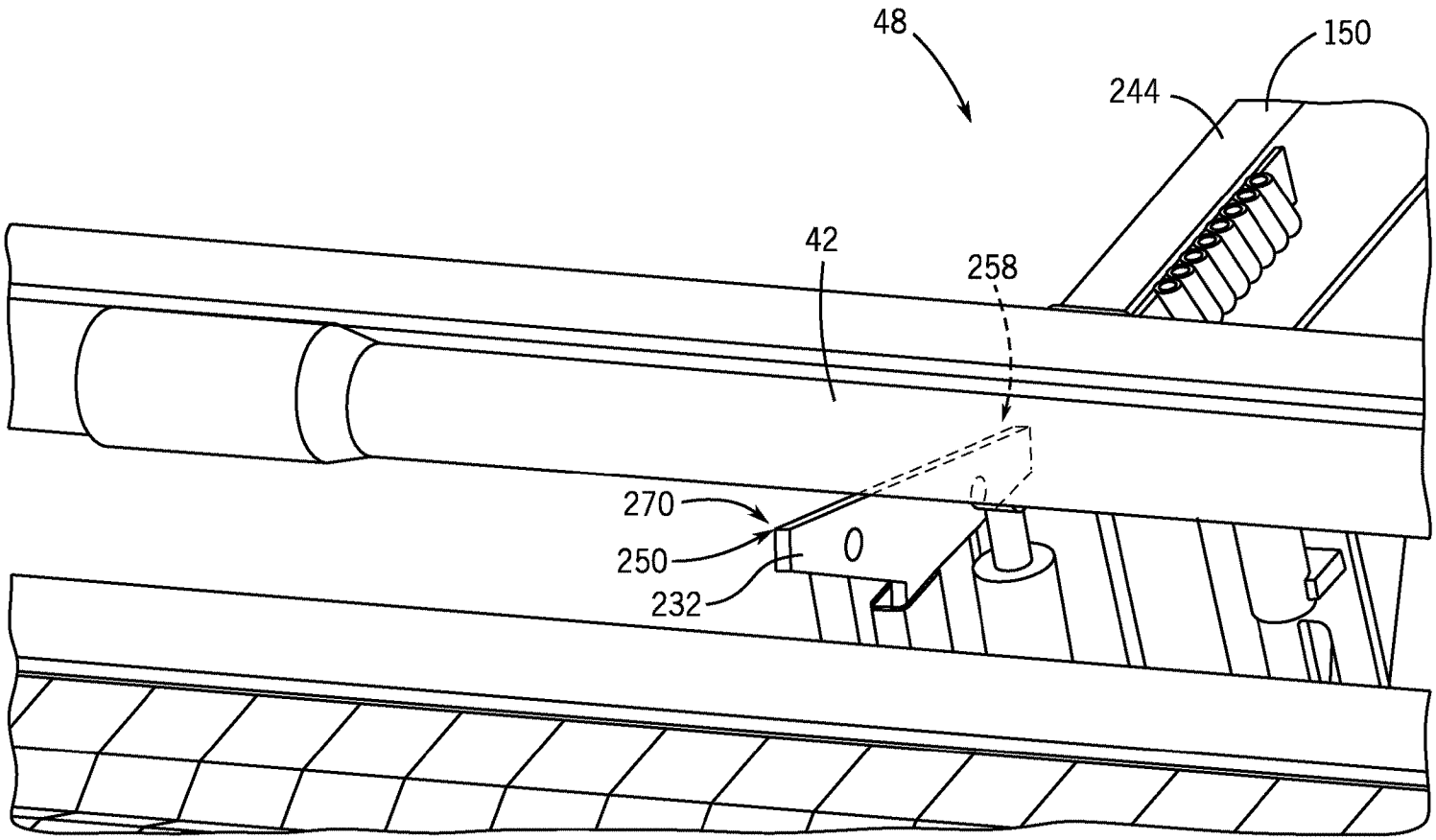
FIG. 17 is a partial perspective view of a catwalk system, illustrating the carriage and trough assembly in a lowered position, in accordance with an embodiment of the present techniques.
Figure 18:
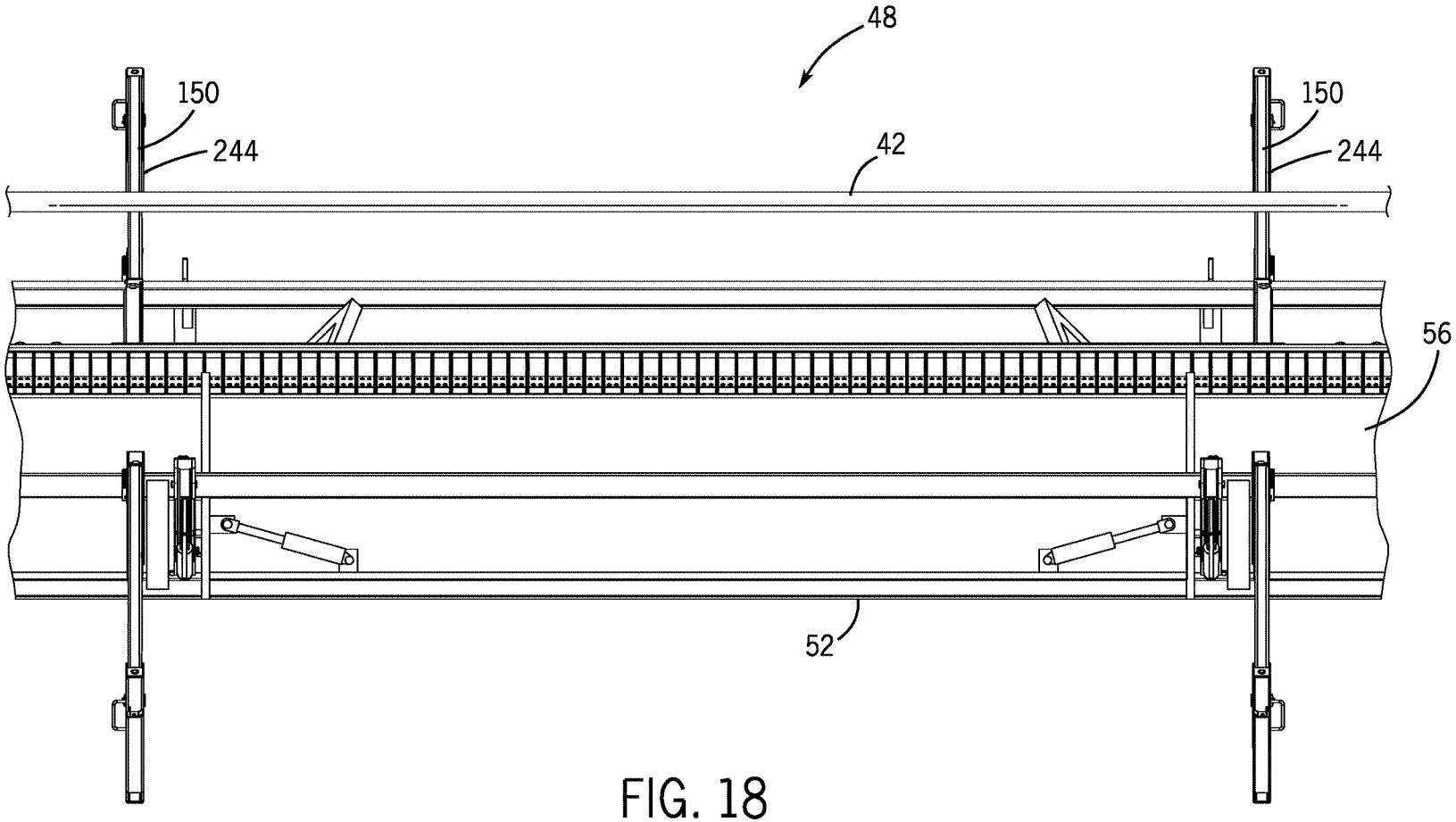
FIG. 18 is a partial perspective view of a catwalk system, illustrating the carriage and trough assembly in a lowered position, in accordance with an embodiment of the present techniques.

When the carriage and trough assembly 56 is lowered to the lowered position 180 shown in FIG. 15, the pins 170 may be lowered to a retracted position 220 (or the pins 170 may be removed) to enable removal of the tubular element 42 from the trough 190. Similar to positioning the tubular element 42 onto the carriage and trough assembly 56, the tubular element 42 may be rolled from the carriage and trough assembly 56 toward the gullwings 150 (e.g., the pair 160 of gullwings 150) such that the tubular element 42 may be transported away from the catwalk system 48 (e.g., via a crane). In some embodiments, additional components may also be included in catwalk system 48 that facilitate removal of the tubular element 42 from the trough 190. For example, FIGS. 16-18 illustrate the use of kickers 230 and rockers 232 of the catwalk system 48 to direct a tubular element 42 from the carriage and trough assembly 56 toward the gullwings 150 of the catwalk system 48.

Figure 16:
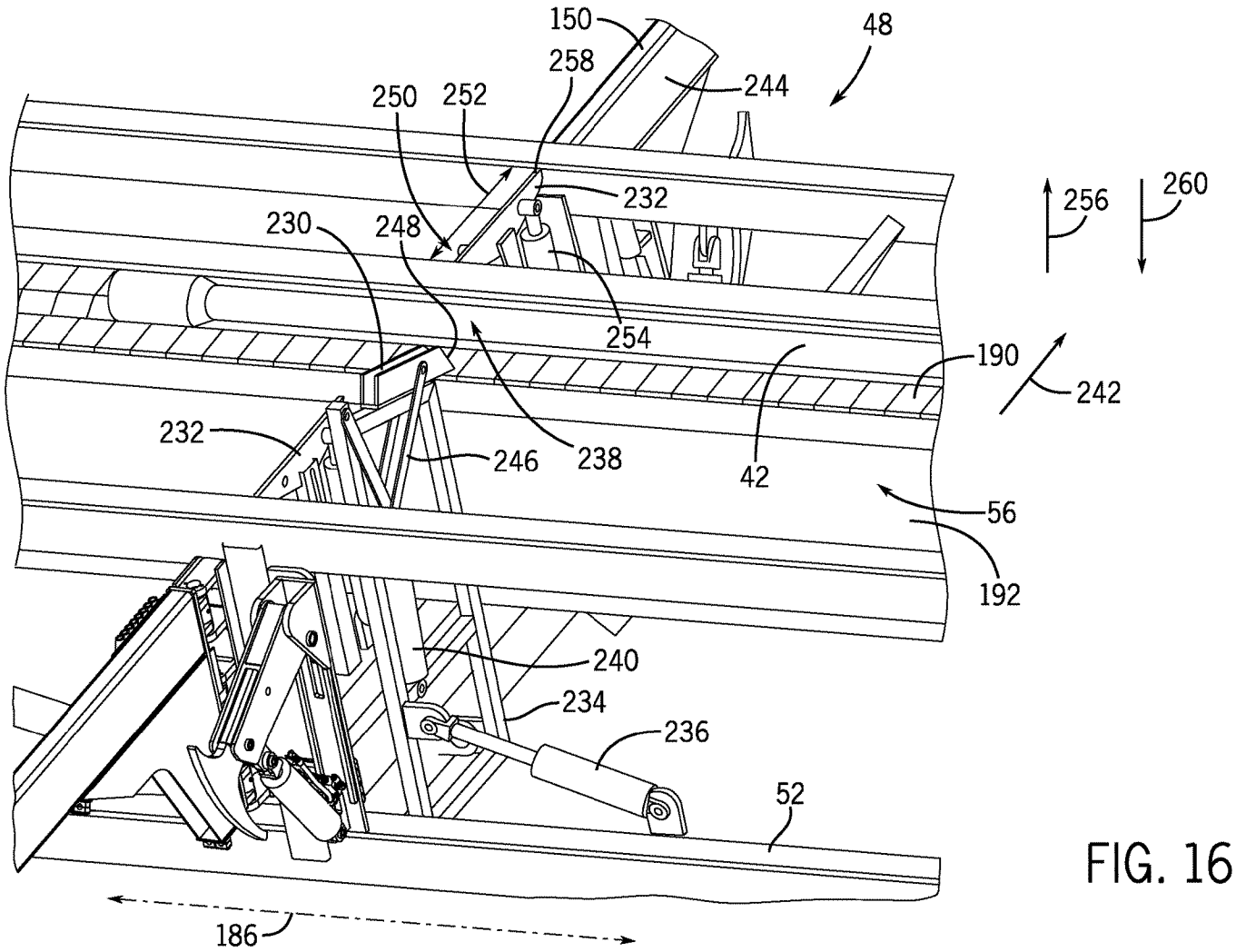
FIG. 16 is a partial perspective view of a catwalk system, illustrating the carriage and trough assembly in a lowered position, in accordance with an embodiment of the present techniques.

For example, FIG. 16 is a partial perspective view of the catwalk system 48, illustrating the carriage and trough assembly 56 in the lowered position 180 as well as the kicker 230 and the rockers 232. For example, the kicker 230 may be coupled to a kicker frame 234, which may be coupled to the base 52 of the catwalk system 48. A position of the kicker frame 234 may be adjusted via a first actuator 236 that is configured to move the kicker frame 234 along the axis 186, and thus, along the base 52. The position of the kicker frame 234 may be adjusted such that the kicker 230 is disposed at a desired location 238 along the tubular element 42 that enables the kicker 230 to move the complete tubular element 42 off the carriage and trough assembly 56. Although the illustrated embodiment of FIG. 16 shows one kicker 230 of the catwalk system 48, the catwalk system 48 may include a second kicker at an opposite end of the tubular element 42. In still further embodiments, the catwalk system 48 may include 0, 3, 4, 5, 6, 7, 8, 9, 10, or more, kickers 230.

The kicker frame 234 may include a second actuator 240 that may be configured to move the kicker 230 in a direction 242 toward a second pair 244 of the gullwings 150. For example, the second actuator 240 may be coupled to arms 246 that are configured to extend in the direction 242 such that the kicker 230 is directed toward the tubular element 42. The kicker 230 may contact the tubular element 42 and urge the tubular element 42 in the direction 242 toward the rocker 232, and thus, toward the second pair of gullwings 244. In certain embodiments, the kicker 230 may include a sloped end 248 that facilitates movement of the tubular element 42 upon contact with the kicker 230. For example, the sloped end 248 may be configured to scoop the tubular element 42 out from the trough 190 and onto the rocker 232.

As shown in the illustrated embodiment of FIG. 16, a first end 250 of the rocker 232 may be flush with the carriage 192 of the carriage and trough assembly 56. Accordingly, the tubular element 42 may be rolled onto the rocker 232 via the kicker 230. Once the tubular element 42 reaches a desired location along a distance 252 of the rocker 232, a third actuator 254 may be activated to extend the first end 250 of the rocker upward in a direction 256. Extending the first end 250 of the rocker 232 in the direction 256 may correspondingly direct a second end 258 of the rocker 232 downward in a direction 260 (e.g., opposite of the direction 256). As such, the rocker 232 forms a sloped surface that enables the tubular element 42 to roll (e.g., via gravitational forces) toward the second pair of gullwings 244, where the tubular element 42 may be transported away from the catwalk system 48.

For example, FIG. 17 is a partial perspective view of the catwalk system 48, illustrating the rocker 232 in a sloped position 270. As shown in the illustrated embodiment of FIG. 17, the first end 250 of the rocker 232 is positioned higher than the second end 258 of the rocker 232 with respect to the ground surface 46 (and/or the second pair of gullwings 244). Therefore, the tubular element 42 may roll toward the second end 258 of the rocker 232 (e.g., as a result of gravitational forces acting on the tubular element 42), and thus, toward the second pair of gullwings 244, as shown in FIG. 18. Once the tubular element 42 is positioned on the second pair of gullwings 244, the tubular element 42 may be transported from the catwalk system 48 (e.g., via a crane).

Figure 19:
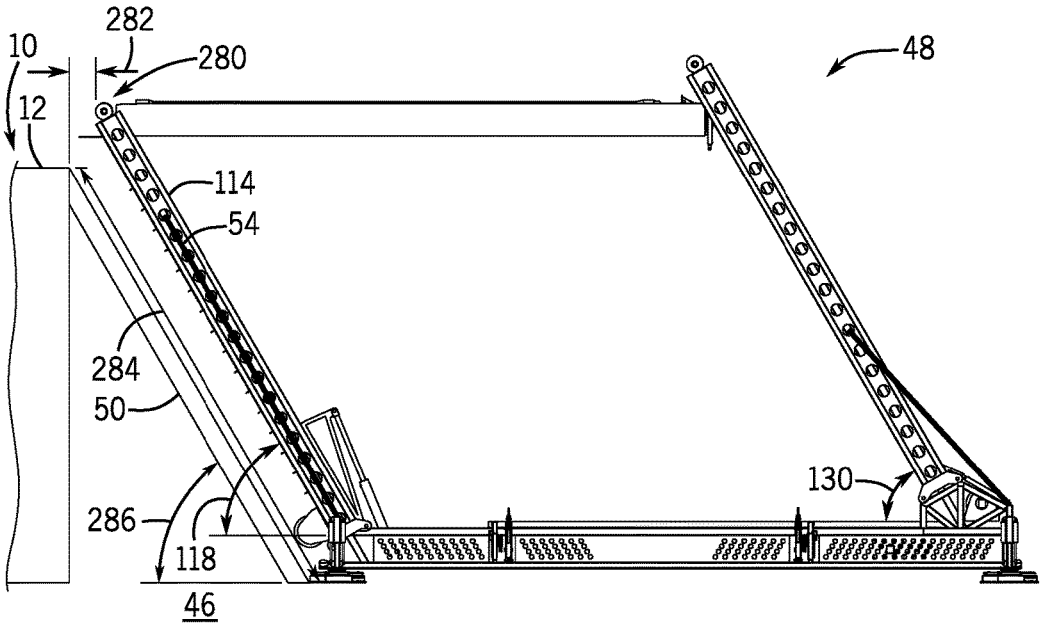
FIG. 19 is a side view of a catwalk system with a carriage and trough assembly in a raised position, in accordance with an embodiment of the present techniques.
Figure 20:
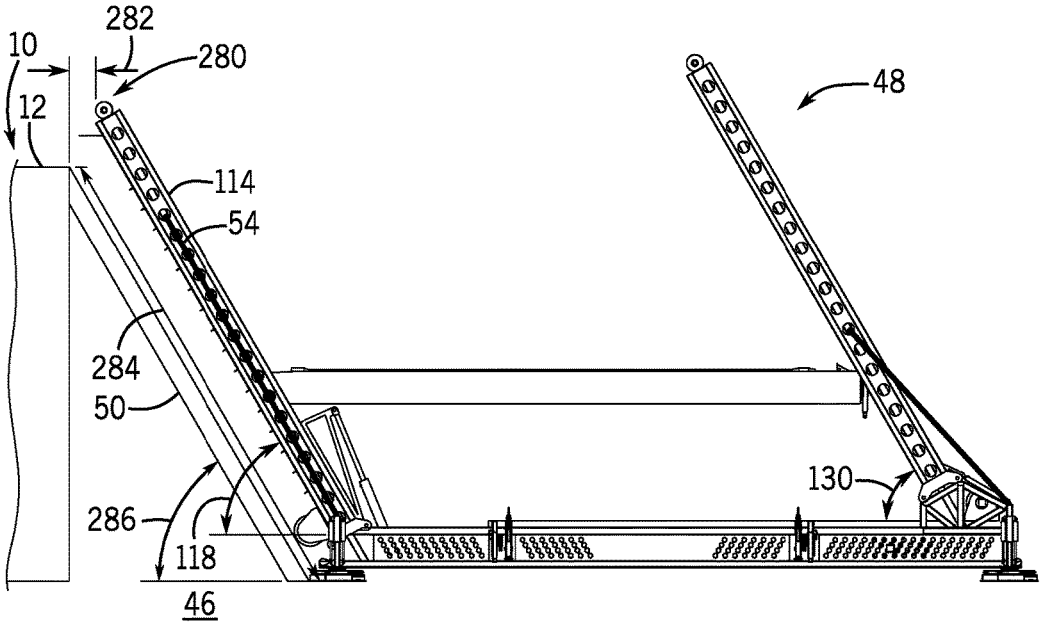
FIG. 20 is a side view of a catwalk system with a carriage and trough assembly in a partially raised position, in accordance with an embodiment of the present techniques.

As discussed above, the catwalk system 48 is configured to raise and lower tubular elements 42 to and from the rig floor 12 in a substantially horizontal orientation (e.g., plus or minus 0 to 20, 1 to 15, 2 to 10, or 3 to 5 degrees) without engaging or touching the drilling rig 10. For example, the catwalk system 48 is placed far enough away from the rig 10 to not interfere or block usage of the V-door 50 or other components of the drilling rig 10, as shown in FIGS. 19 and 20. In certain embodiments, a top end 280 of the front column 114 may be a distance 282 from the rig floor 12. The distance 282 may be predetermined based on a length 284 and/or slope of the V-door 50, such that the catwalk system 48 does not contact the V-door 50 (or other component of the drilling rig 10). In such embodiments, the carriage and trough assembly 56 is configured to cover or extend the distance 282, such that the tubular element 42 may be transported toward the wellbore 34. Additionally, the angles 118 and 130 of the columns 54 may be similar to an angle 286 of the V-door 50 (e.g., with respect to the ground surface 46). For example, the angles 118, 130, and/or 286 may be substantially equal (e.g., within 5%, within 2%, or within 1% of one another). Extending the columns 54 at substantially the same angle as the angle 286 of the V-door 50 may block contact between the columns 54 and the V-door 50 because such features would be substantially parallel to one another (e.g., within 5%, within 2%, or within 1% of one another).

Figure 21:
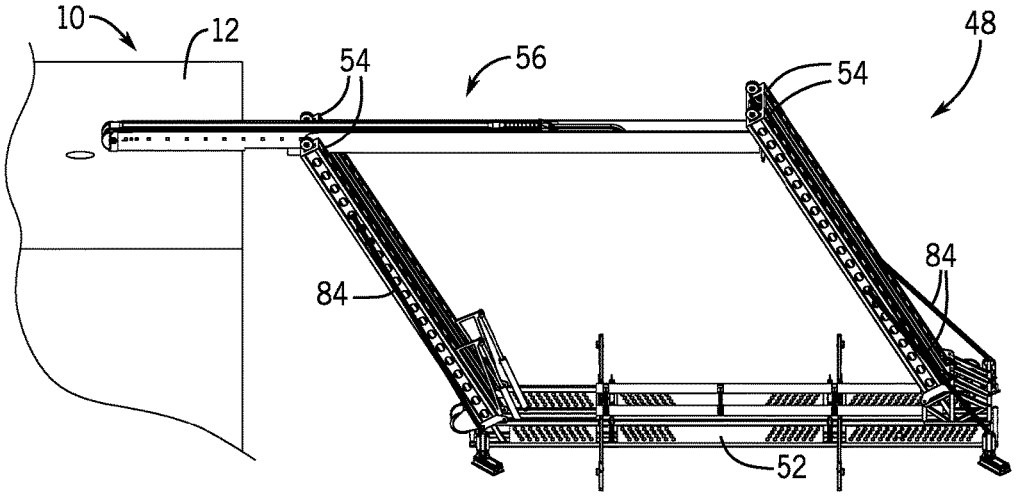
FIG. 21 is a perspective view of a catwalk system, illustrating the carriage and trough assembly in a raised position with the trough in an extended position, in accordance with an embodiment of the present techniques.

As described in previously disclosed embodiments, the columns may have the cross bracing 115, however, other embodiments of the columns may not have the cross-bracing 115 to enable the carriage and trough assembly 56 to reach a wider range of rig floor 12 heights. For example, FIGS. 21-23 are perspective views of the catwalk system 48, illustrating the columns 54 without cross-bracing 115. As shown in the illustrated embodiments of FIGS. 21-23, the carriage and trough assembly 56 of the catwalk system 48 may extend toward the rig floor 12 without obstruction caused by the cross-bracing. Indeed, the trough 190 of the carriage and trough assembly 56 may extend through an opening 300 between the front column 114. The opening 300 extends substantially throughout a length 302 of the front column 114, such that the trough 190 may extend through the opening 300 at nearly every position along the front column 114. Accordingly, the catwalk system 48 may be configured to reach a wide range of rig floor 12 heights.

As will be appreciated, the catwalk system 48 may include other components to enable additional functionality. For example, the catwalk system 48 may include a controller or other control system configured to coordinate and/or synchronize operation of one or more components of the catwalk system 48. For example, a control system may coordinate operation of winches, cranes, the conveyor 58, the trough and carriage assembly 56, hydraulic cylinders, elevators, the kickers 230, the rockers 232, and so forth to optimize operation of the catwalk assembly 48 (e.g., to increase efficiency). In certain embodiments, the control of the catwalk system 48 may be further optimized based on measured feedback, such as a leveling sensor of the catwalk system 48 configured to monitor the horizontal orientation of the carriage and trough assembly. The catwalk system 48 may further include other accessories or components to improve operation of the catwalk system 48. For example, the carriage and trough assembly 56 may include containers or compartments that may be used to raise and lower tools or other components with in addition to the tubular elements 42. In certain embodiments, the base 52 of the catwalk system 48 may include an integrated tubular rack for storing or transporting tubular elements 42. In certain embodiments, the catwalk system 48 may be "walked out" to and/or from the drilling rig 10 to adjust the position of the catwalk system 48. For example, the catwalk system 48 may be walked out via legs, extensions, stabilizers 100, or other components of the catwalk system 48. In certain circumstances, the catwalk system 48 may be walked out and/or returned to a position next to the drilling rig 10 when the columns are erected and secured in place.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A catwalk system, comprising:

a base;

a plurality of columns extending from the base, wherein each of the plurality of columns is rigid in an erected configuration; and a carriage and trough assembly configured to translate along the plurality of columns to lift a tubular element from a lowered position to a raised position in a substantially horizontal orientation, wherein the plurality of columns is configured to remain stationary as the carriage and trough assembly is translated from the lowered position to the raised position.

2. The catwalk system of claim 1, wherein the carriage and trough assembly comprises a carriage and a trough disposed in the carriage, and wherein the trough is configured to extend horizontally from the carriage to convey the tubular element toward a rig floor.

3. The catwalk system of claim 1, comprising a first front column of the plurality of columns coupled to a second front column of the plurality of columns, and comprising a first rear column of the plurality of columns coupled to a second rear column of the plurality of columns.

4. The catwalk system of claim 3, comprising a first opening between the first front column and the second front column and a second opening between the first rear column and the second rear column.

5. The catwalk system of claim 3, wherein the first front column and the second front column are coupled to one another with first cross-bracing, and wherein the first rear column and the second rear column are coupled to one another with second cross-bracing.

6. The catwalk system of claim 1, comprising one or more stabilizers coupled to the base, wherein the one or more stabilizers are configured to expand one or both of a width or an area of the base.

7. The catwalk system of claim 1, wherein the carriage and trough assembly comprises pins disposed in a trough of the carriage and trough assembly, wherein the pins are configured to extend from the trough to secure the tubular element within the carriage and trough assembly when the carriage and trough assembly translates along the plurality of columns.

8. The catwalk system of claim 1, comprising one or more gullwings coupled to the base, wherein the one or more gullwings are configured to receive the tubular element and facilitate positioning the tubular element on the carriage and trough assembly.

9. The catwalk system of claim 1, comprising a brace coupled to the base and extending toward a column of the plurality of columns, wherein the brace is configured to support the column of the plurality of columns.

10. The catwalk system of claim 1, wherein each of the plurality of columns forms a first angle with the base that is substantially equal with a second angle formed between a V-Door of a drilling rig and a ground surface.

* * * * *